US007866003B2

(12) United States Patent
Tooyama

(10) Patent No.: US 7,866,003 B2
(45) Date of Patent: Jan. 11, 2011

(54) DAMPING DEVICE

(75) Inventor: Hiroaki Tooyama, Tokyo (JP)

(73) Assignee: K. K. Murakoshi Seikoh, Tokyo (JP)

( * ) Notice: Subject to any disclaimer, the term of this patent is extended or adjusted under 35 U.S.C. 154(b) by 500 days.

(21) Appl. No.: 10/597,072

(22) PCT Filed: Oct. 15, 2004

(86) PCT No.: PCT/JP2004/015269

§ 371 (c)(1),
(2), (4) Date: Mar. 7, 2007

(87) PCT Pub. No.: WO2005/068760

PCT Pub. Date: Jul. 28, 2005

(65) Prior Publication Data

US 2008/0244862 A1 Oct. 9, 2008

(30) Foreign Application Priority Data

Jan. 13, 2004 (JP) ..... 2004-005811

(51) Int. Cl.
*B25G 3/32* (2006.01)

(52) U.S. Cl. ..... 16/422

(58) Field of Classification Search ..... 16/50, 16/63, 71, 78, 79, 80, 81, 72, 73, 74, 75, 16/64, 65, 82, 83, 84, 85, 86 R, 86 A, 86 B; 188/82.1

See application file for complete search history.

(56) References Cited

U.S. PATENT DOCUMENTS 4,179,134 A * 12/1979 Atkinson ..... 280/87.042
4,872,239 A * 10/1989 Ferguson et al. ..... 16/64
4,967,512 A * 11/1990 Schroder et al. ..... 49/367
5,448,797 A * 9/1995 Coleman ..... 16/85
6,253,417 B1 * 7/2001 Rusiana ..... 16/82
6,848,759 B2 * 2/2005 Doornbos et al. ..... 312/319.1
7,240,978 B2 * 7/2007 Kobayashi et al. ..... 312/333

FOREIGN PATENT DOCUMENTS

JP 5-317133 A 12/1993
JP 7-269221 A 10/1995
JP 11-264270 A 9/1999
JP 2000-220341 A 8/2000

OTHER PUBLICATIONS

English Translation of International Preliminary Report on Patentability, for PCT Application No. PCT/JP2004/015269, filed Oct. 15, 2004, 5 pages.

* cited by examiner

*Primary Examiner*—Victor Batson
*Assistant Examiner*—Matthew Sullivan
(74) *Attorney, Agent, or Firm*—Sterne, Kessler, Goldstein & Fox P.L.L.C.

(57) ABSTRACT

A buffer which can achieve a buffering effect corresponding to the speed of a sliding door is provided. Corresponding to the abutment force of an engagement pin 3 which is on a sliding door 2 with respect to a retaining recessed portion 67 of a hook body 61 which is slidably provided in a case body, an engagement stepped portion 71 of the hook body 61 presses a pressing member 44, and a brake pad 47 of the pressing member 44 and a brake pad 39 of a slider 31 come into sliding contact with a brake plate 28.

5 Claims, 19 Drawing Sheets

【Fig. 1】
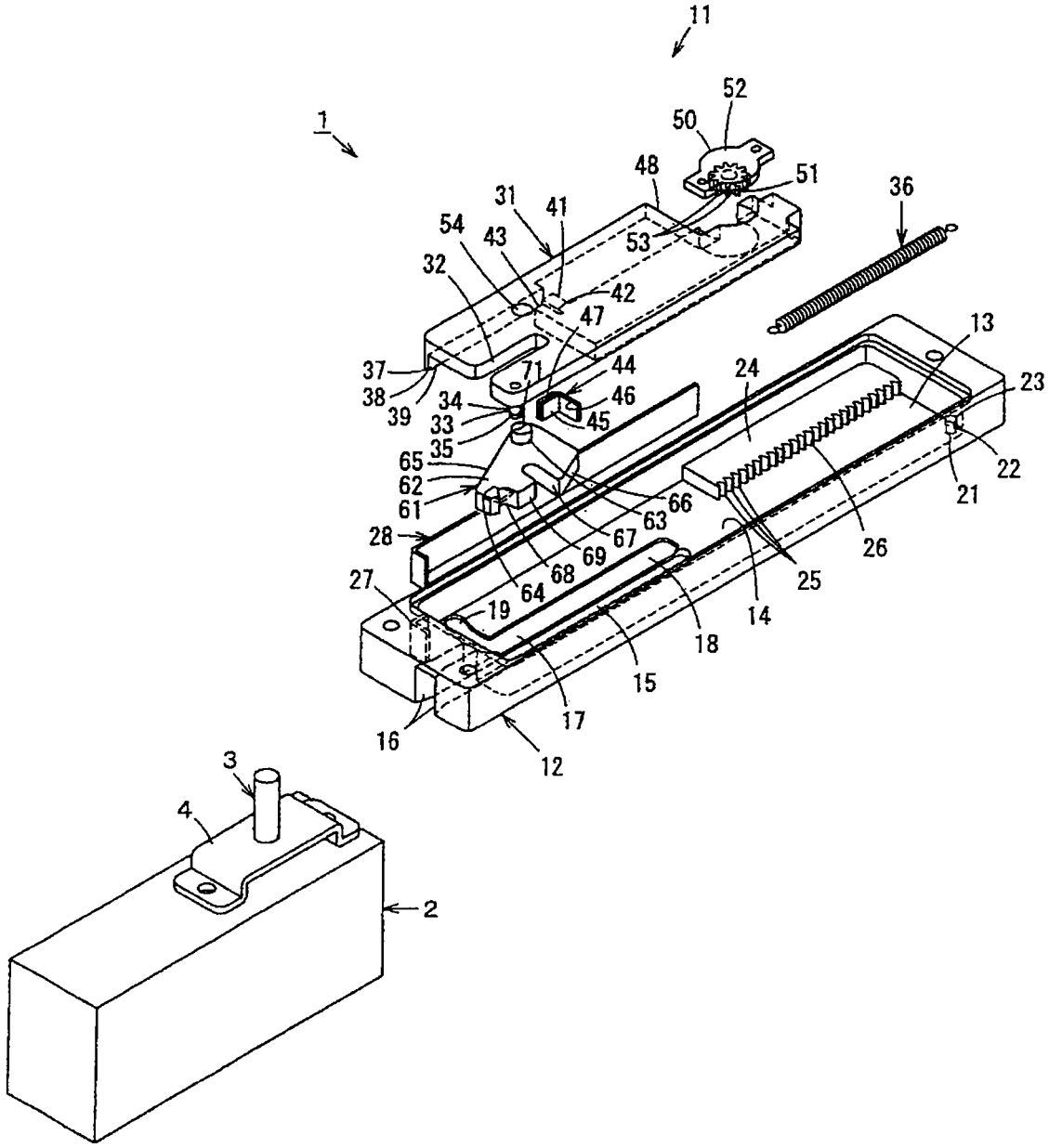

【Fig. 2】
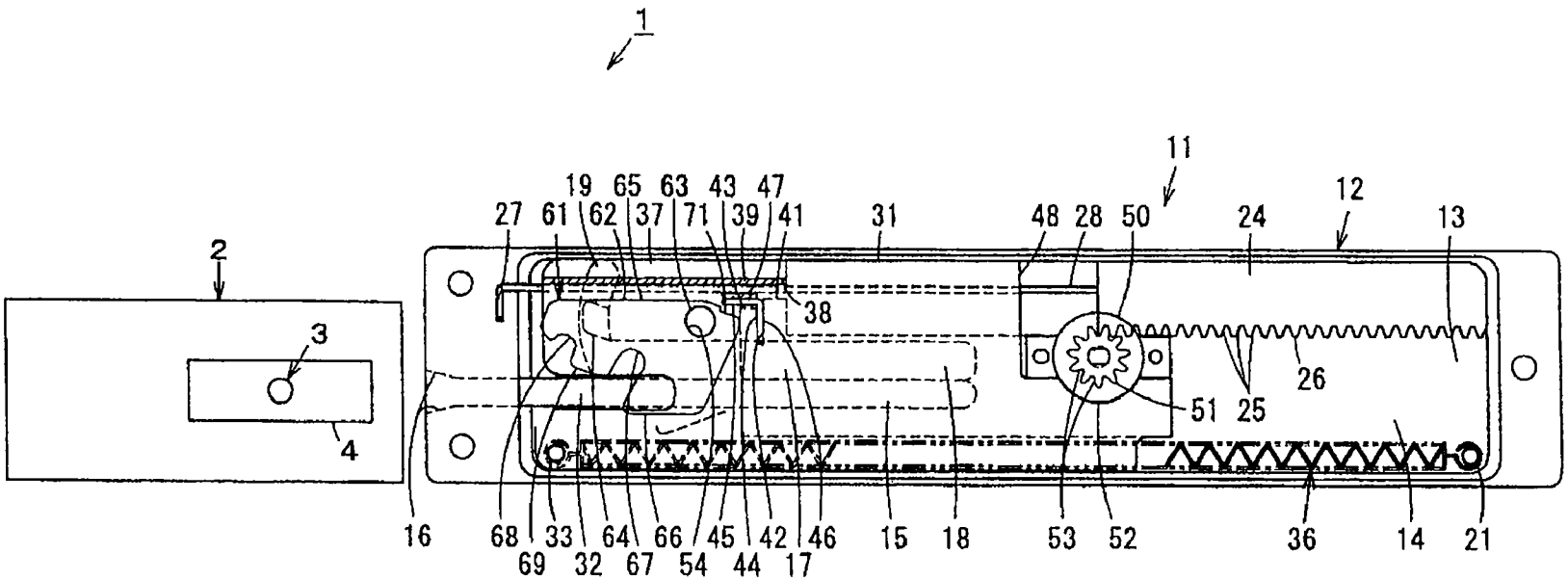

【Fig. 3】
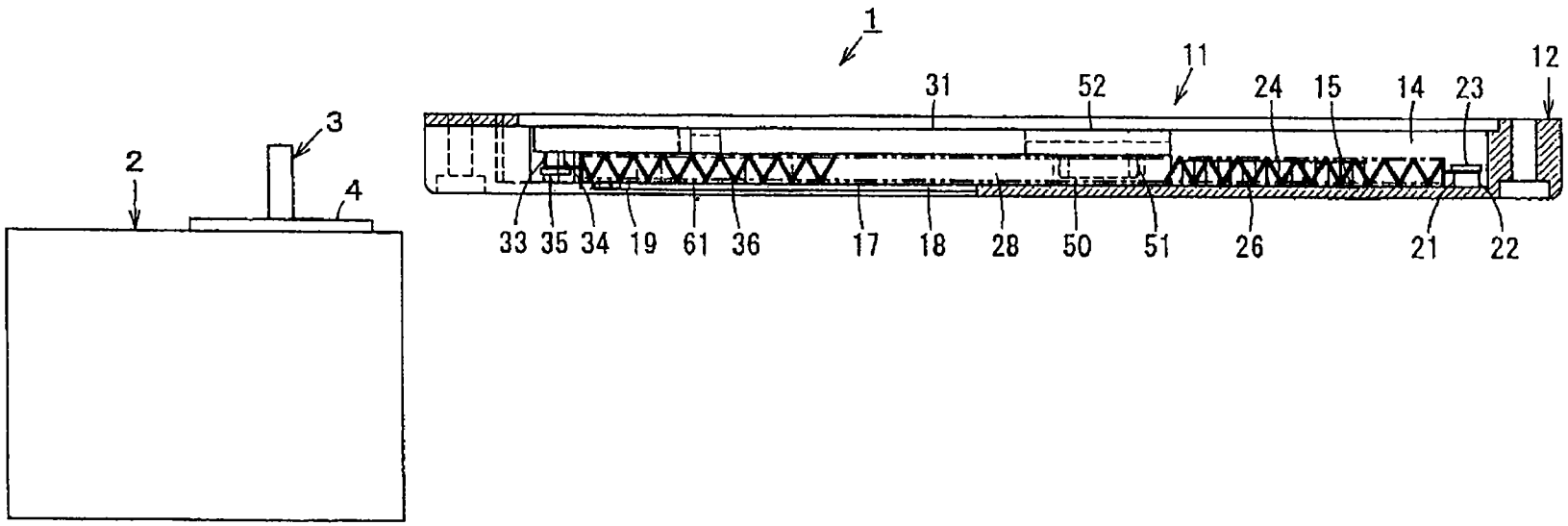

【Fig. 4】
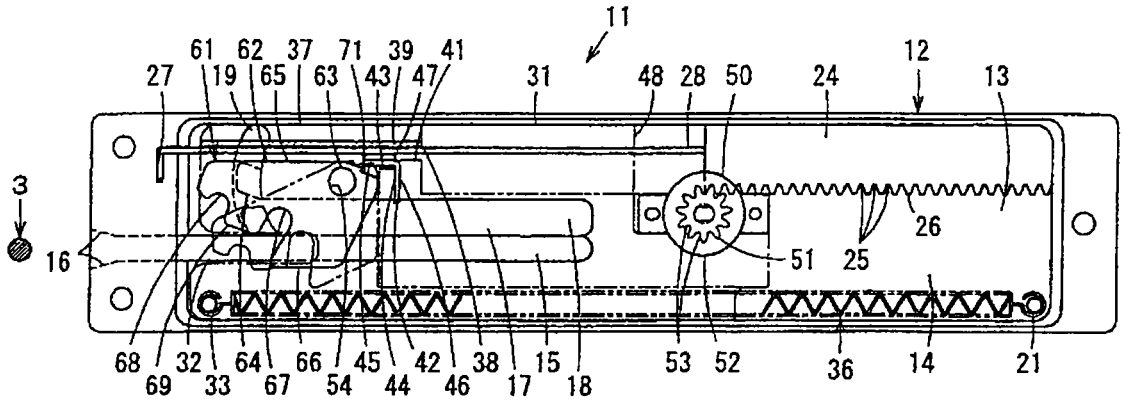
【Fig. 5】
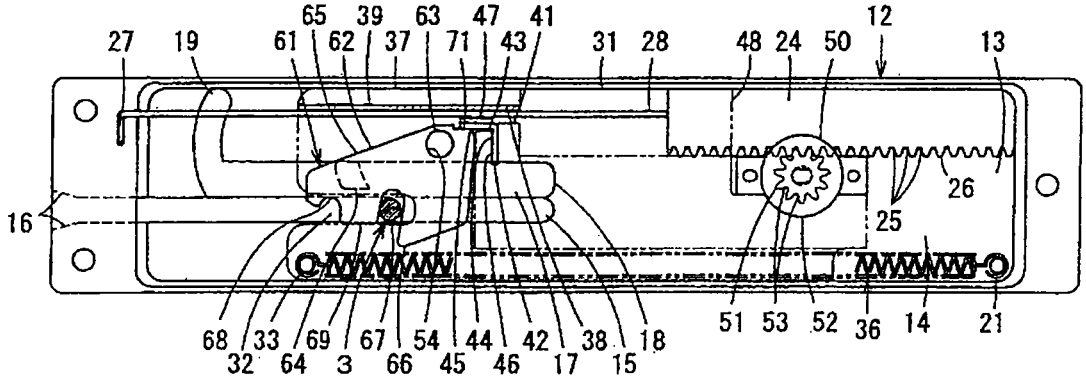
【Fig. 6】
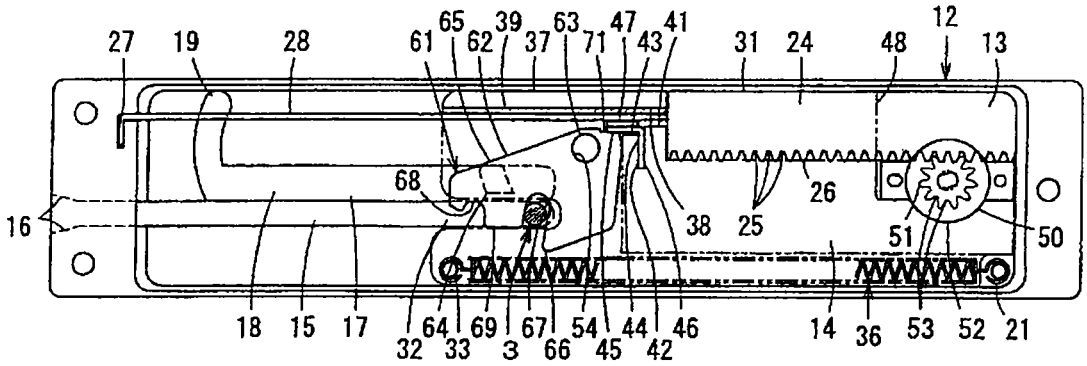

【Fig. 7】
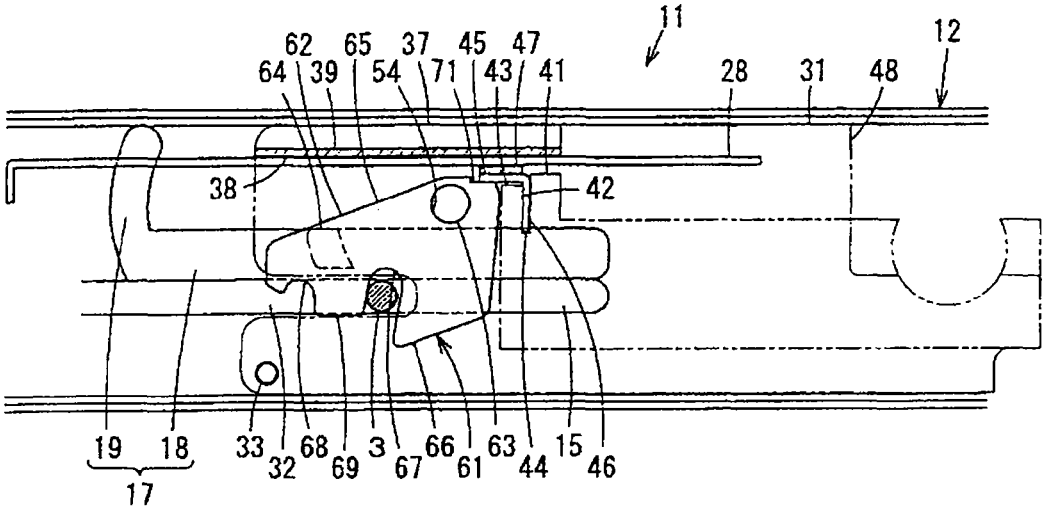
【Fig. 8】
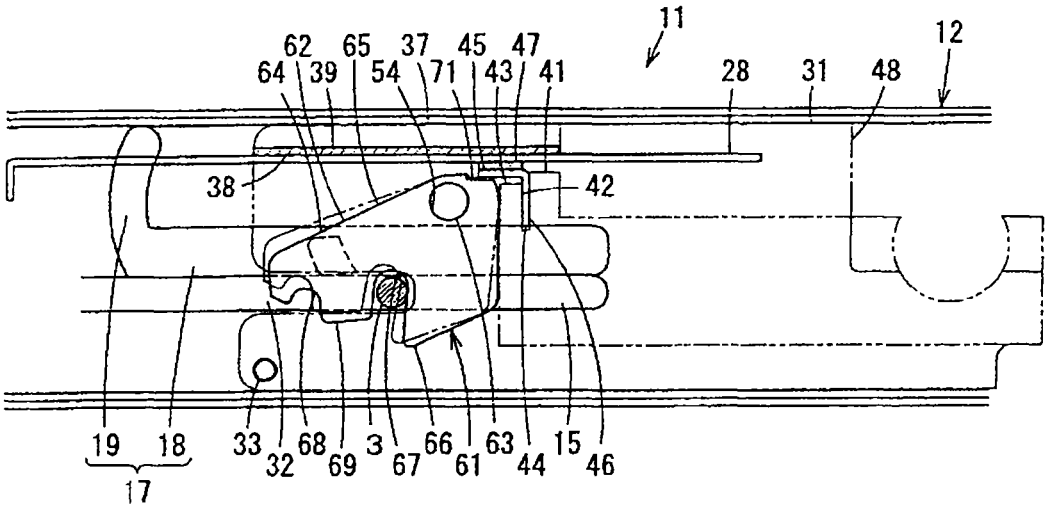

【Fig. 9】
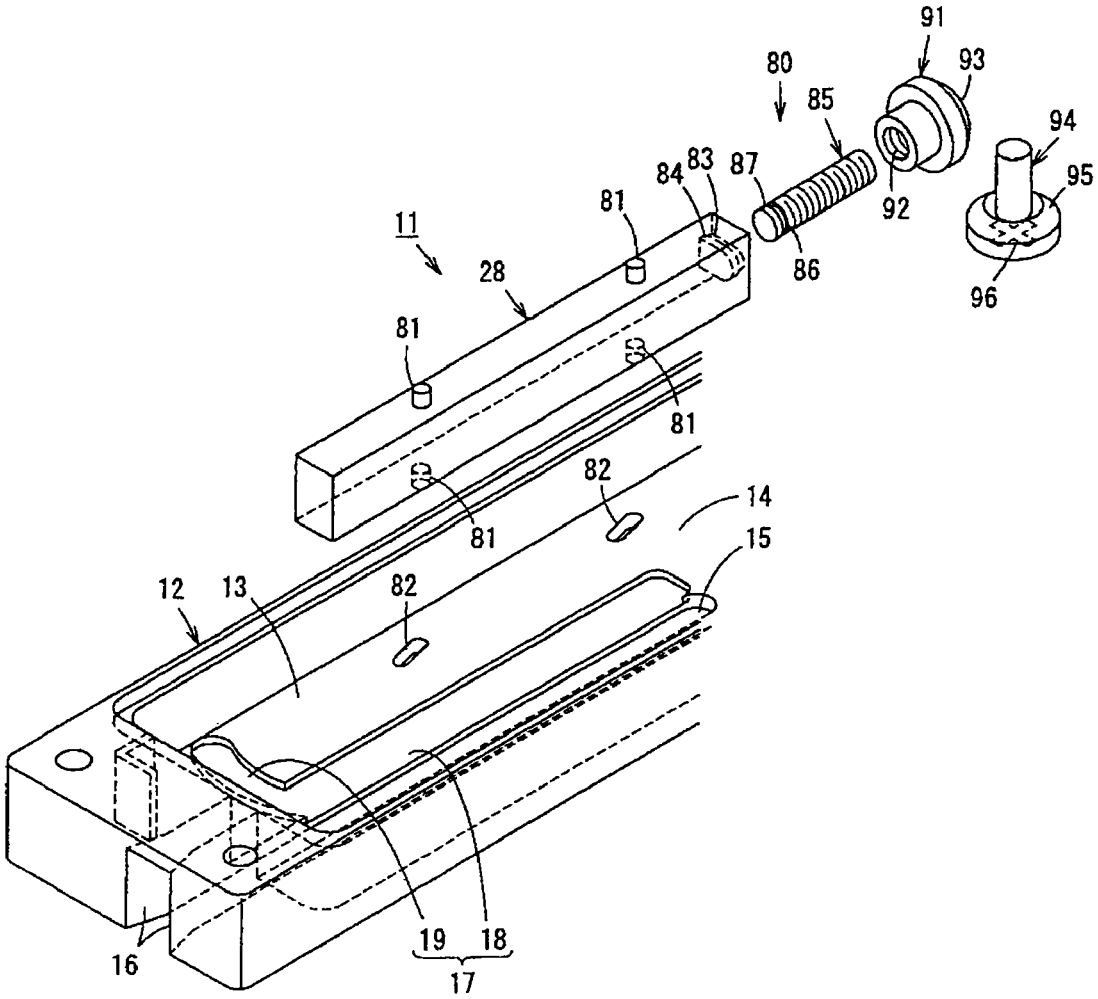
【Fig. 10】
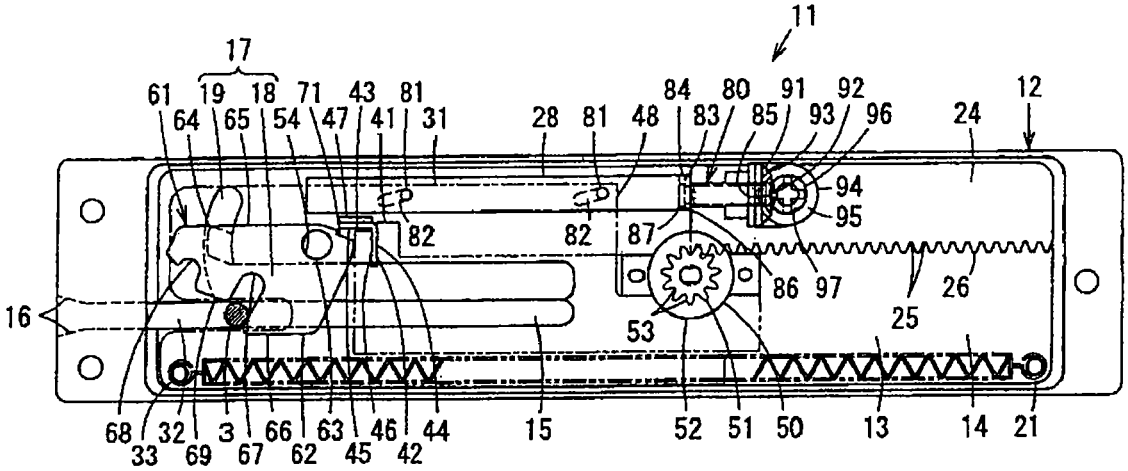

【Fig. 11】
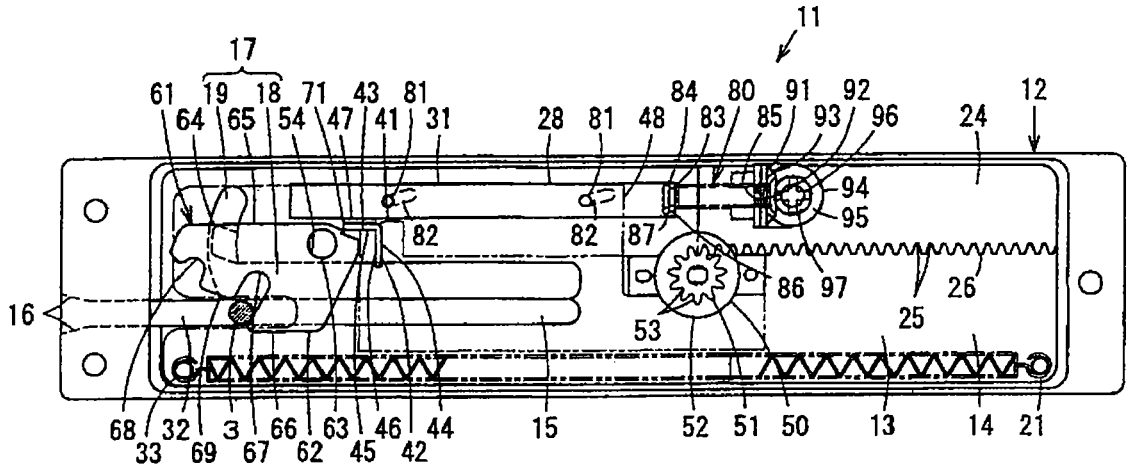
【Fig. 12】
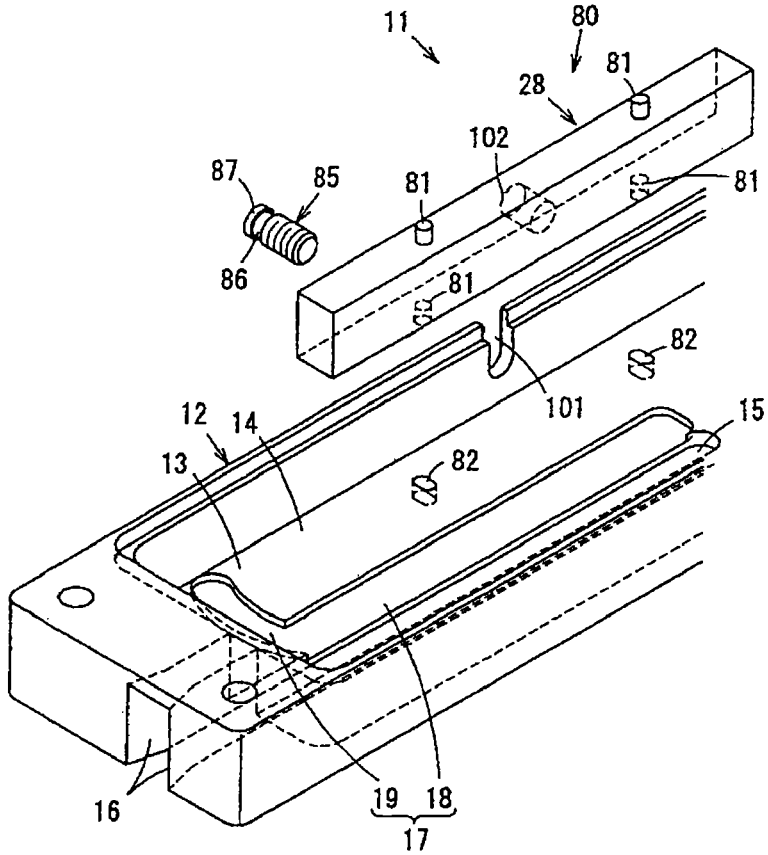

【Fig. 13】
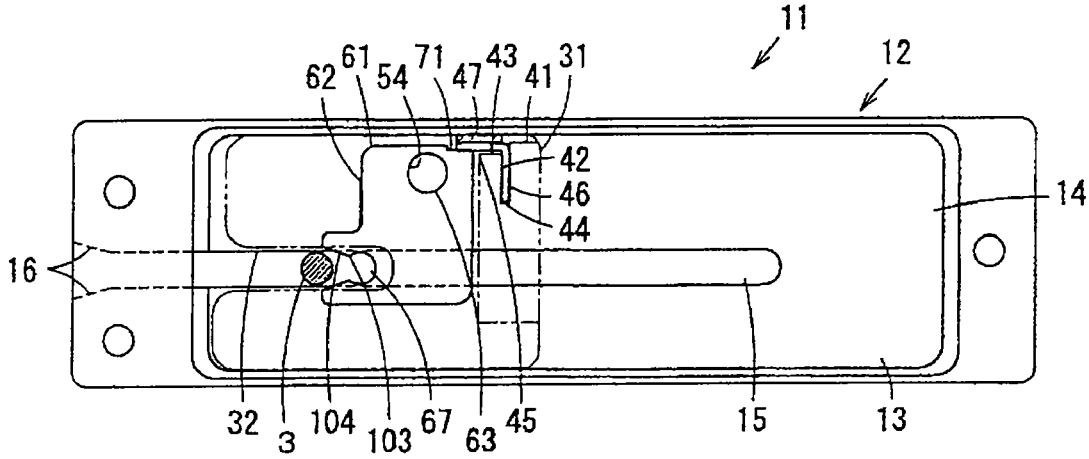
【Fig. 14】
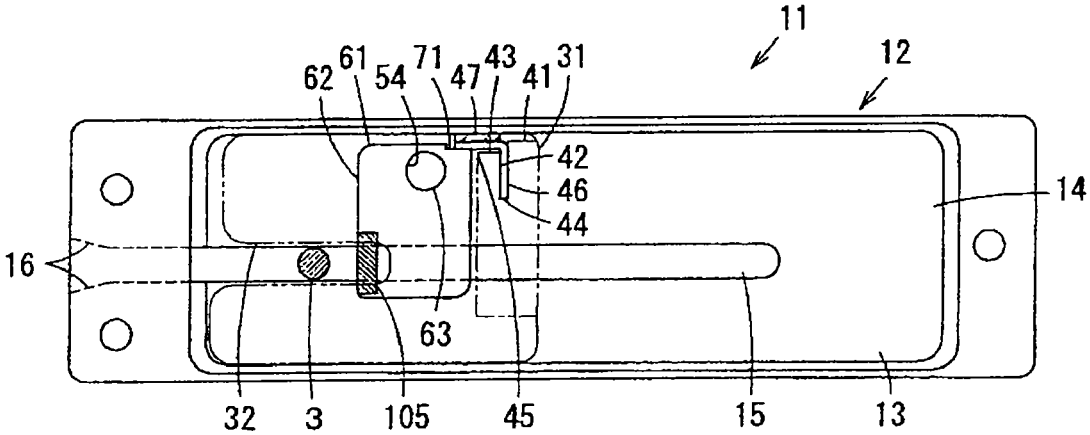

【Fig. 15】
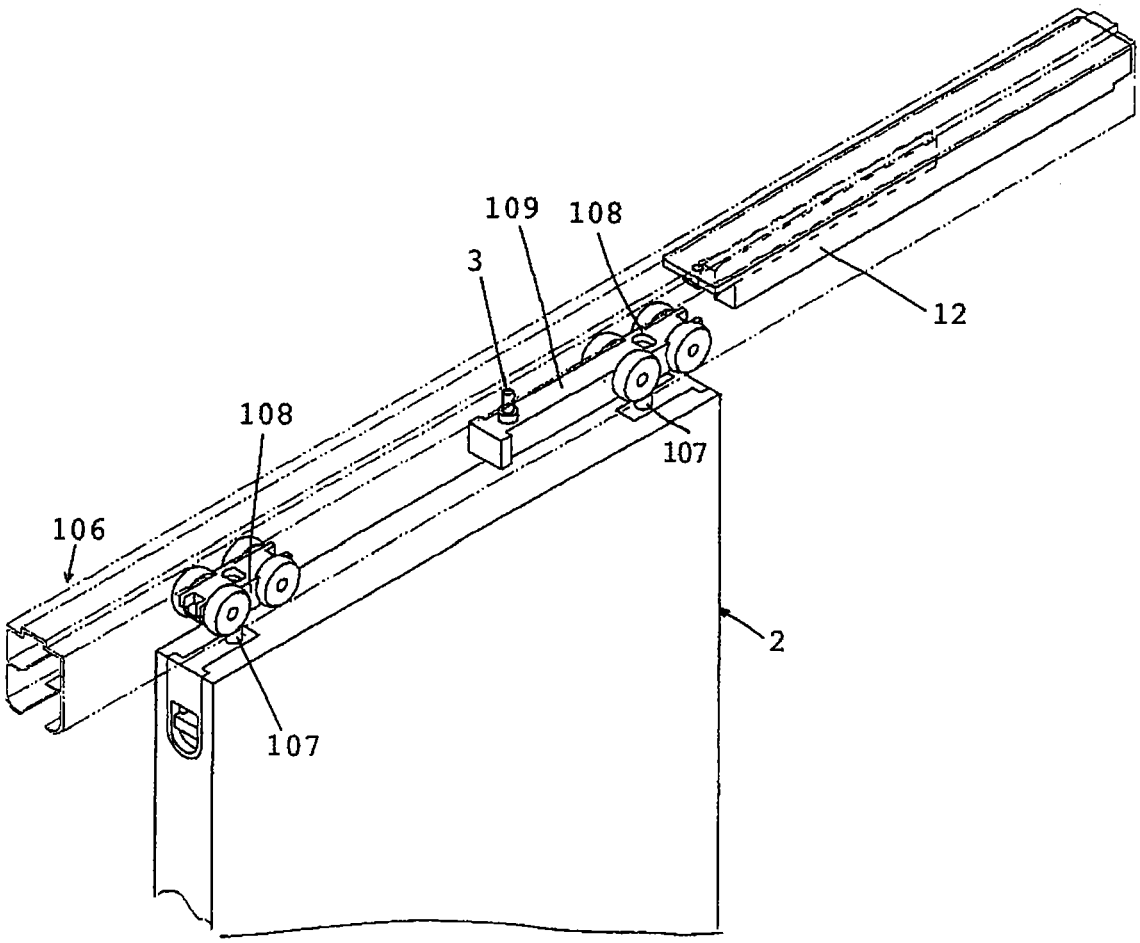

【Fig. 16】
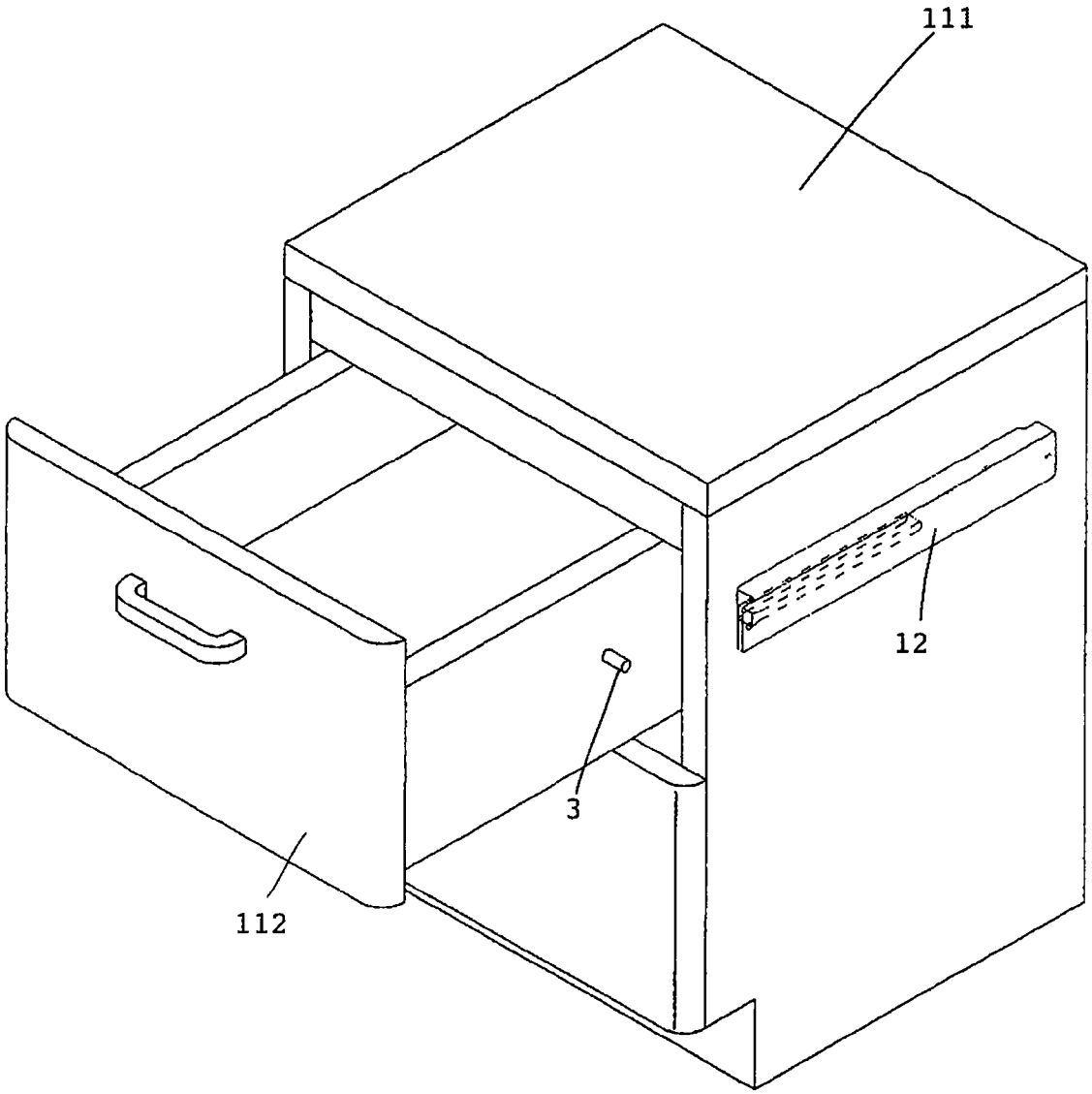

【Fig. 17】
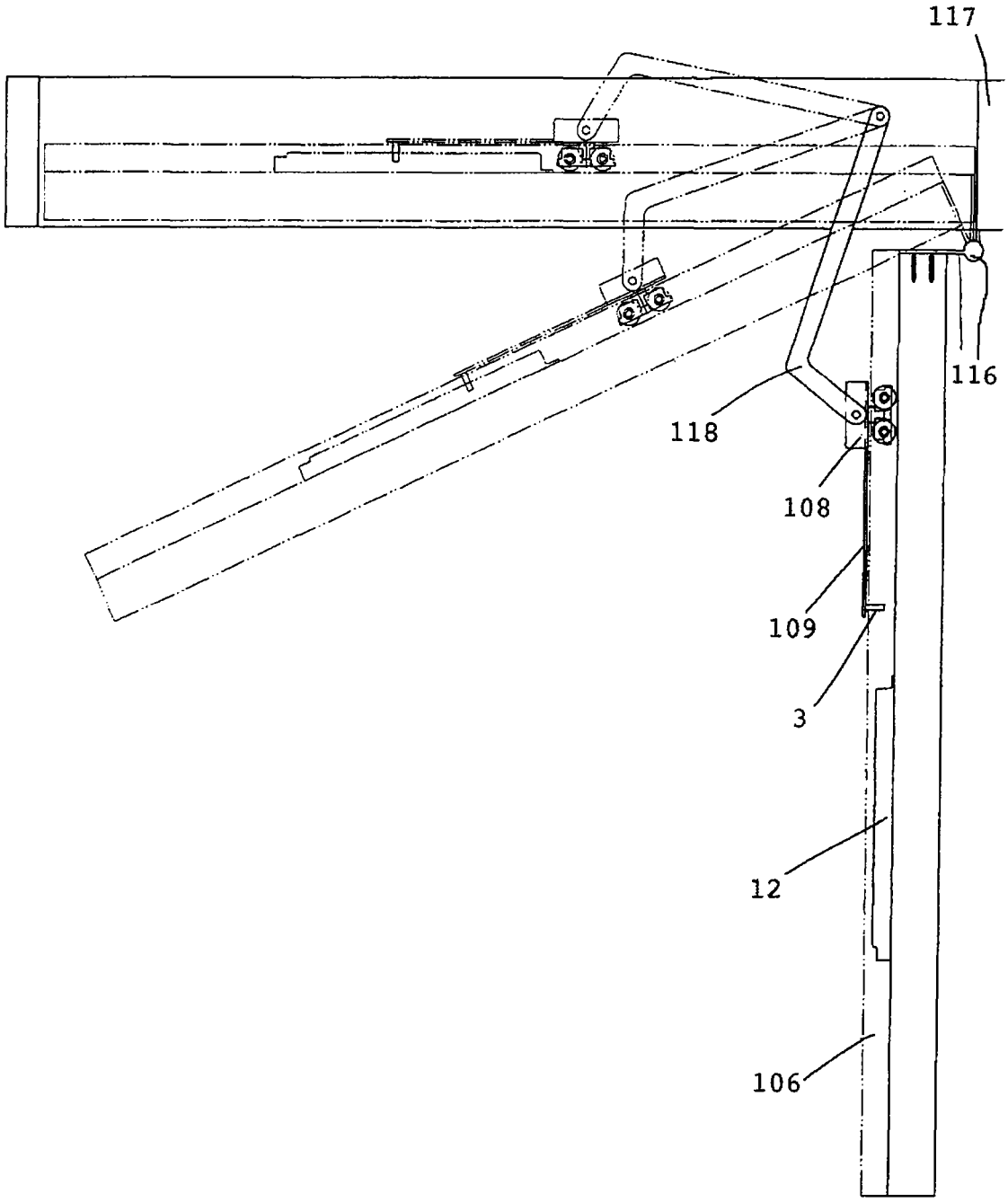

【Fig. 18】
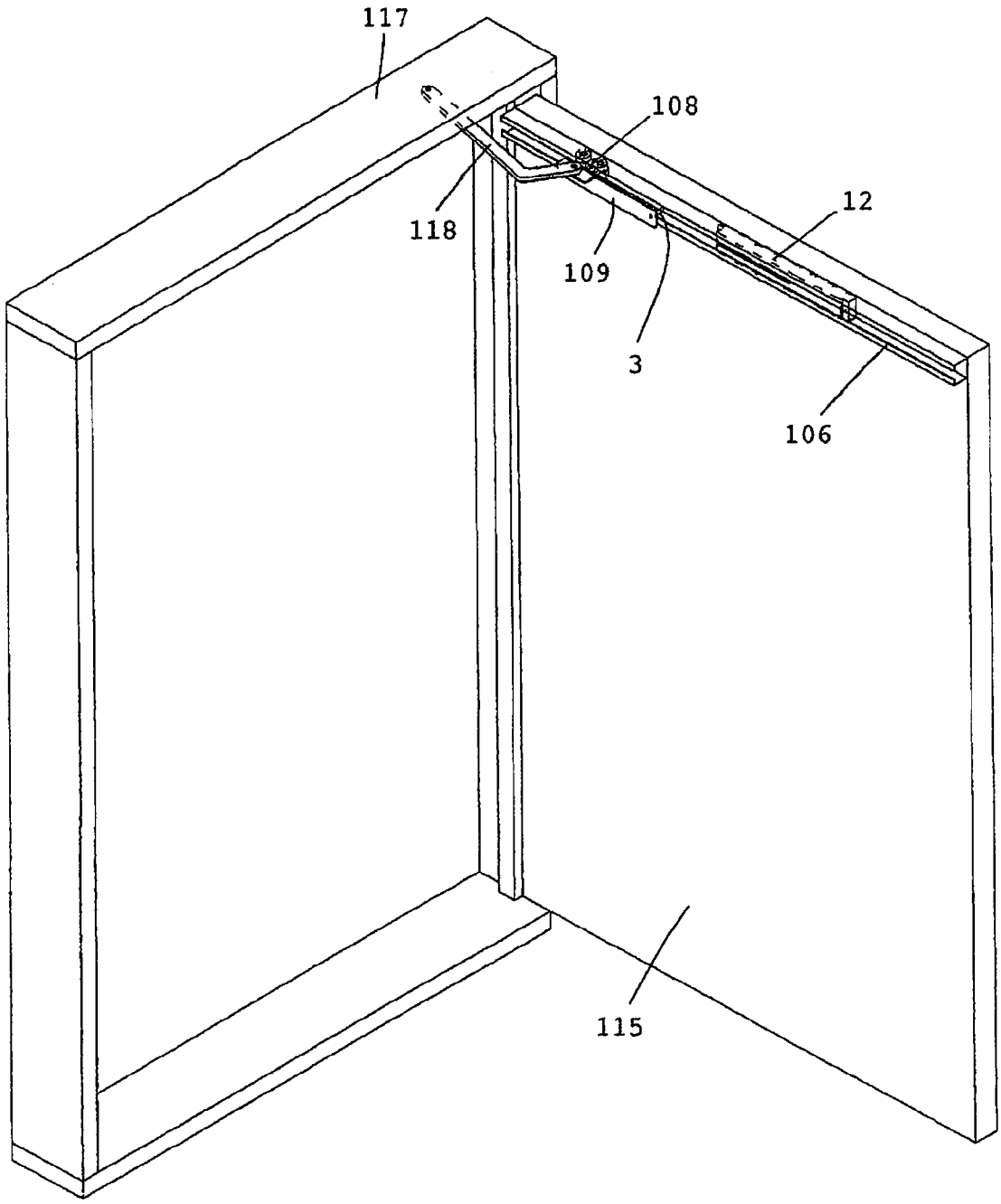

【Fig. 19】
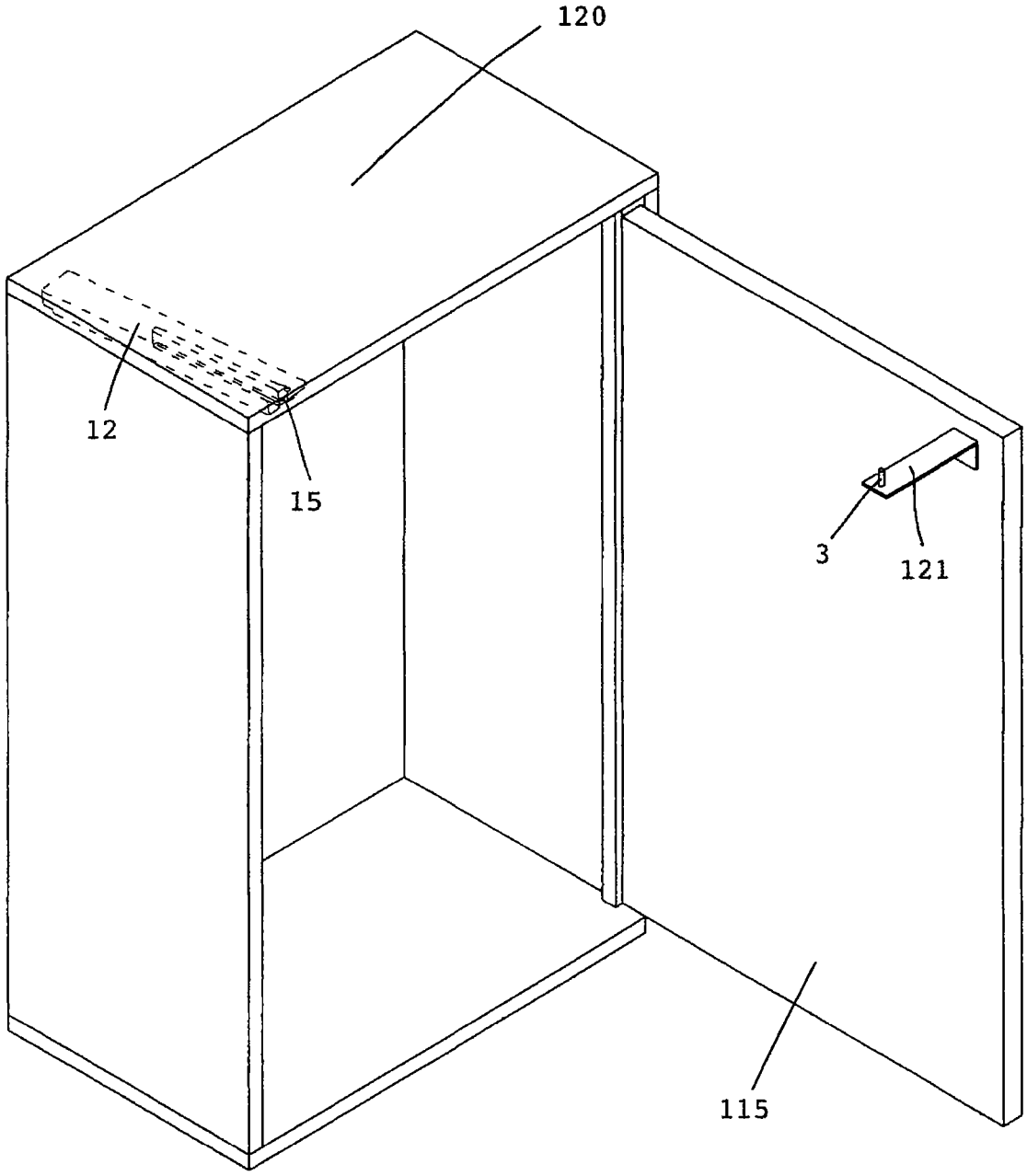

【Fig. 20】
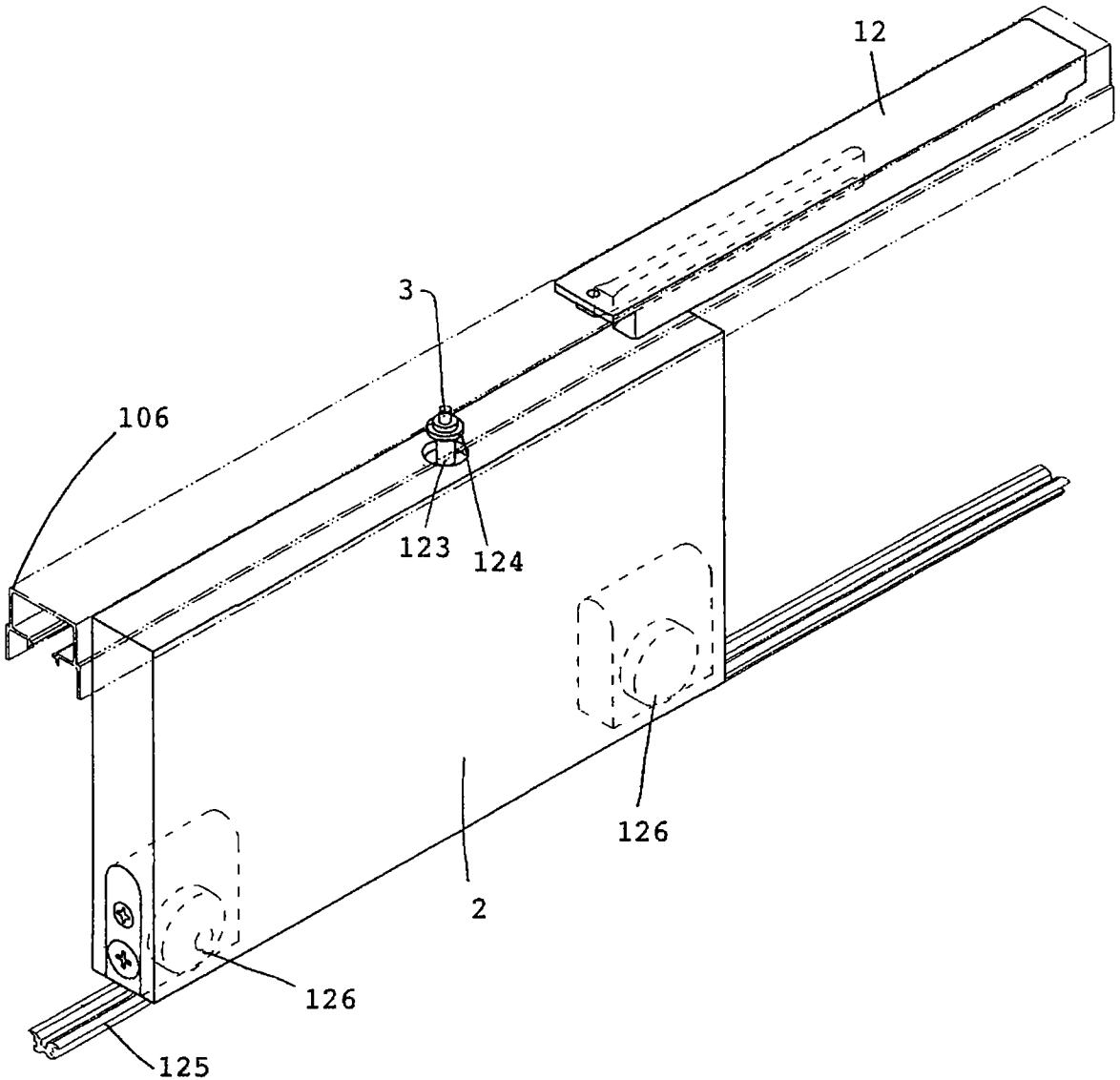

【Fig. 21】
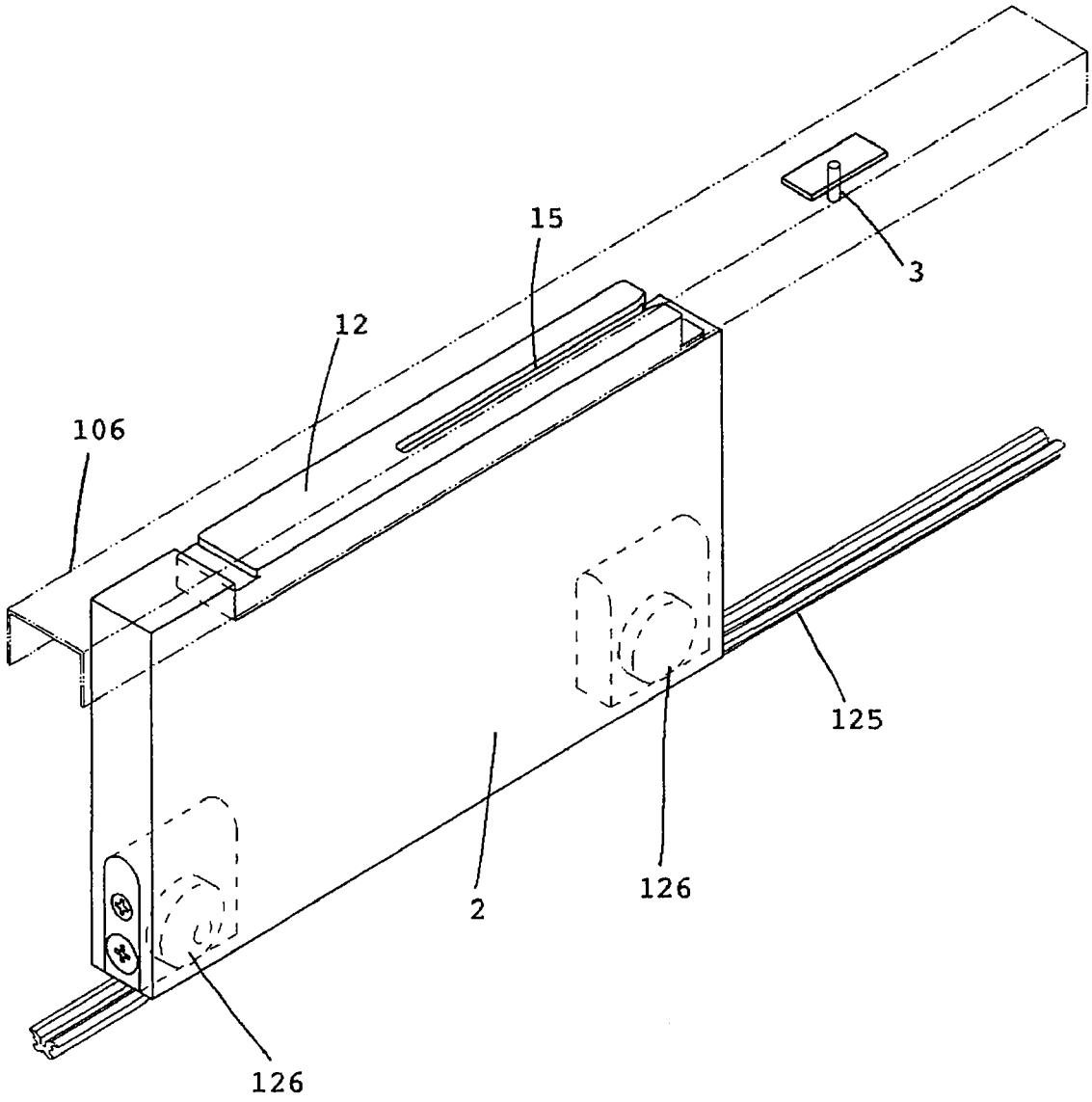

【Fig. 22】
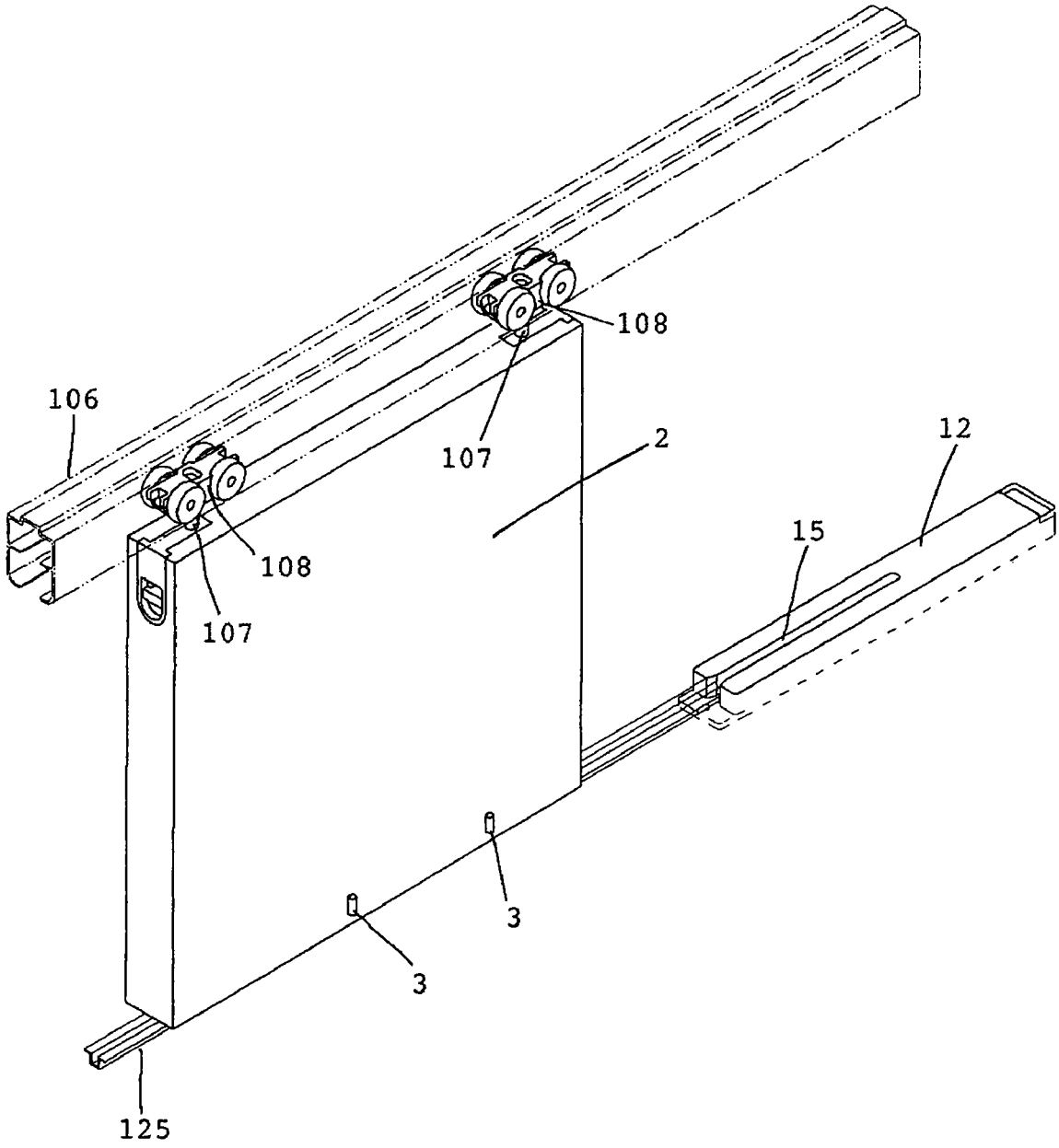

【Fig. 23】
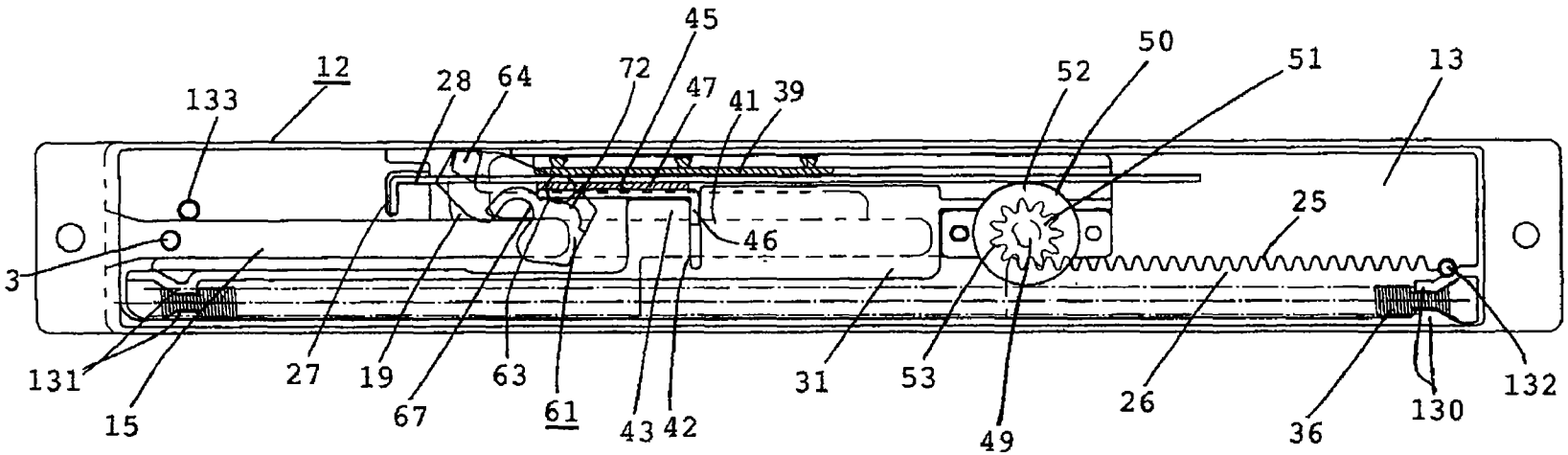

【Fig. 24】
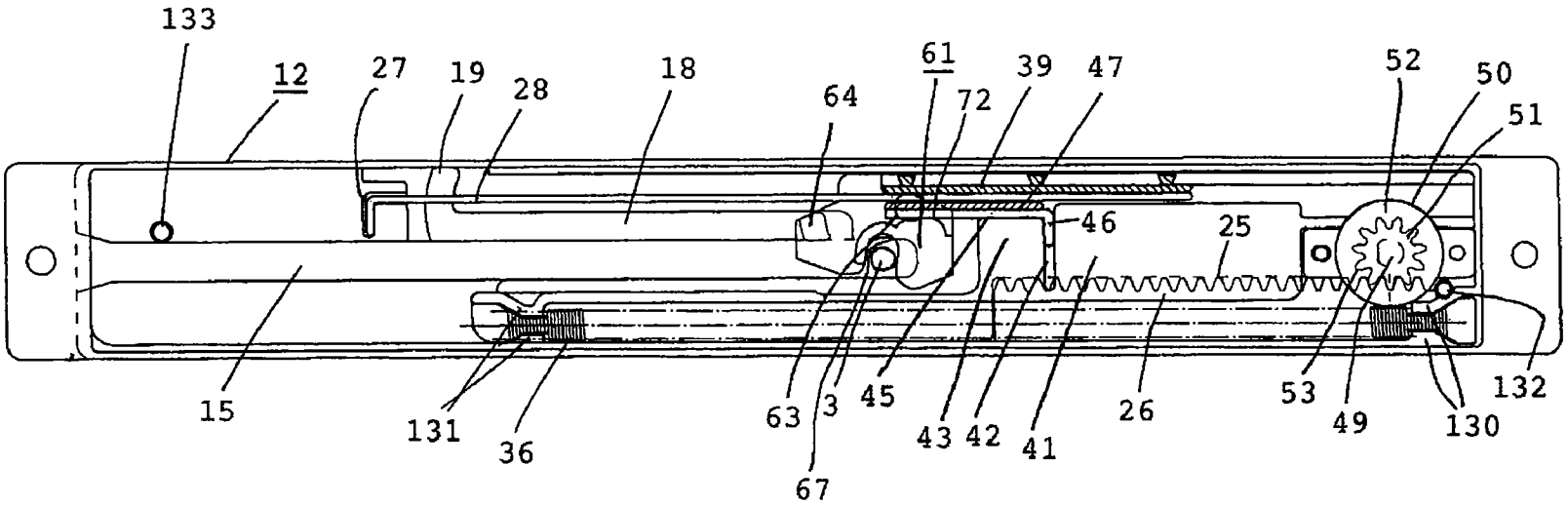

【Fig. 25】
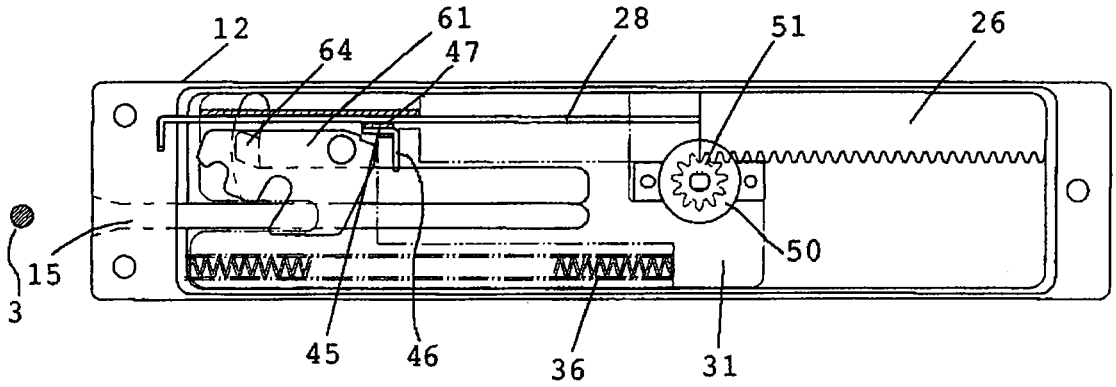
【Fig. 26】
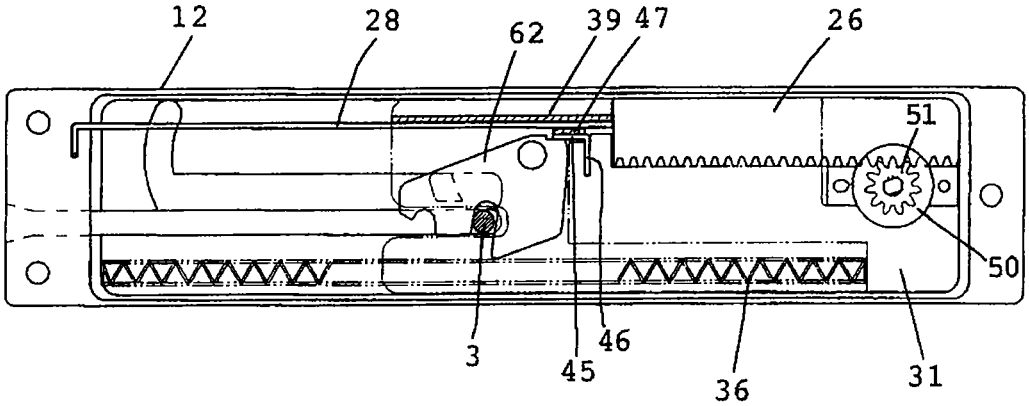

DAMPING DEVICE

BACKGROUND OF THE INVENTION

1. Field of the Invention

The present invention relates to a buffer for buffering relative movement of a first member and a second member.

2. Background Art

Conventionally, as a buffer of this kind, there has been a buffer stopper for a sliding door for preventing violent closing of the sliding door. This buffer stopper for a sliding door has a substrate fixed to a groove rail for the sliding door. A constitution thereof in which, to the substrate attached is a spring intensity adjustment means comprised of a spring plate of which center in the longitudinal direction is curved in the thickness direction is known (for example, see Patent Document 1).

As another buffer, there is a constitution in which a rotary damper having a casing and a drum disposed in the casing wherein the casing is filled with a silicone oil is supported by a carrier fixed to a pull-out rail, a pinion gear is fixed to the rotation axis of the rotary damper, a slider is horizontally slidably attached in a groove of the carrier, the slider has a rack meshed with the pinion gear, one end of a tension spring is fixed to the slider, and the other end thereof is fixed to the carrier. This buffer is used such that, during a buffering action of the rotary damper, the drum is pressed against a retaining shoe on the outer periphery of the casing (see Patent Document 2).

Patent Document 1: Japanese Patent Application Laid-Open (kokai) Gazette No. H7-286474 (pp 2 to 4. FIG. 3 and FIG. 6) Patent Document 2: U.S. Pat. No. 6,666,306 (second column, third column; FIG. 1 to FIG. 10).

BRIEF SUMMARY OF THE INVENTION

However, since the above described buffer stopper for a sliding door is arranged to reliably close a sliding door which is serving as a moving member by means of the elastic force of the spring plate, the stopper is on the assumption that the speed for closing the sliding door, i.e., the closing speed is constant. Therefore, when the closing speed of the sliding door is different, the buffering effect corresponding to the closing speed of the sliding door cannot be obtained.

Specifically, when the closing speed of the sliding door is fast, the sliding door may be bounded back due to the inertia that the sliding door has. On the other hand, when the closing speed of the sliding door is slow, there is a problem that the sliding door may be stopped before the sliding door is completely closed. The publicly known buffer for a drawer involves a problem that the entire device is enlarged when an object having a weight such as a sliding door is to be buffered, since the buffer achieves a buffering effect solely by the rotary damper.

The present invention has been accomplished in view of the foregoing, and an object of the present invention is to provide a buffer which can achieve a buffering effect corresponding to the moving speed of either one of the first member or the second member.

Means for Solving the Problems

A buffer as described in claim 1 has: a first member, a case body relatively movable with respect to the first member, a slider provided in the case body so as to be slidable in a longitudinal direction of the case body, and a buffering member rotatably attached to the slider; wherein the buffering member is rotated through abutment with the first member, has an engagement stepped portion or a cam projecting portion for directly or indirectly pressing the case body or a member fixed to the case body, and moves along with movement of the first member or the case body while retaining the pressing state caused by the engagement stepped portion or the cam projecting portion so as to buffer relative movement of the first member and the case body.

The buffering member which is rotatably attached to the slider provided in the case body so as to be slidable in the longitudinal direction of the case body directly or indirectly presses the case body or the member fixed to the case body through abutment caused by relative movement of the first member and the buffering member. Corresponding to the pressing force, the friction resistance force with respect to the relative movement is increased, and buffering corresponding to the relative moving speed of the first member and the case body can be achieved.

The buffer as described in claim 2 is constituted such that the engagement stepped portion or the cam projecting portion of the buffering member presses the case body or the member fixed to the case body indirectly via a pressing member.

The buffer as described in claim 3 is constituted such that the buffering member presses a brake plate fixed to the case body.

The buffer as described in claim 4 is constituted such that the position of the brake plate is adjustable in the width direction of the case body.

In the buffer as described in claim 5, a flat abutting surface to be brought into sliding contact with one side surface of the brake plate is formed on the slider.

The buffer as described in claim 6 has a rotary damper fixed to the slider, a pinion gear fixed to a rotation axis of the rotary damper, and a rack fixed to the case body; wherein the pinion gear and the rack are meshed with each other.

By virtue of the above constitution, a braking action of the rotary damper and a buffering action based on the meshing resistance force caused by the pinion gear and the rack assist the buffering action which is caused by directly or indirectly pressing the case body or the member fixed to the case body by the buffering member.

The buffer as described in claim 7 has a rack fixed to the slider, a rotary damper fixed to the case body, and a pinion gear fixed to a rotation axis of the rotary damper; wherein the pinion gear and the rack are meshed with each other. This constitution is obtained by reversing the arrangement of the rotary damper including the pinion gear and the rack in the buffer of claim 6, and effects similar to that of claim 6 can be obtained.

The buffer as described in claim 8 has an elastic means for moving the slider between the slider and the case body.

In this case, when the abutting force caused by movement of either one of the first member and the case body reaches a predetermined value below the elastic force of the elastic means, by virtue of rotary motion of the buffering member attached to the slider, the slider can be automatically energized by the elastic means in the moving direction after the buffering member undergoes a posture change to the retaining posture.

The buffer as described in claim 9 has a constitution such that the buffering member has a retaining recessed portion for retaining the first member, and is moved along with the movement of the first member or the case body via the retaining recessed portion.

The buffer as described in claim 10 has a constitution such that the buffering member has a magnet, the first member is formed of a magnetic body, and the magnet can attract and retain the first member.

BRIEF DESCRIPTION OF THE DRAWINGS

[FIG. 1] An exploded perspective view showing a first embodiment of a buffer of the present invention.

[FIG. 2] A plan view showing the buffer shown in FIG. 1.

FIG. 3 is a side view showing the buffer shown in FIG. 1.

FIG. 4 is an explanatory view showing a state of a waiting posture of the buffer shown in FIG. 1 before abutment with a buffering member.

FIG. 5 is an explanatory view showing a state of the buffer shown in FIG. 1 in a retaining posture wherein retainment is performed by the buffering member.

FIG. 6 is an explanatory view showing a state of the buffer shown in FIG. 1 in a pull-in retaining posture caused by the buffering member.

FIG. 7 is an explanatory view showing a state when the abutting force of the buffer shown in FIG. 1 is small.

FIG. 8 is an explanatory view showing a state when the abutting force of a second member of the buffer shown in FIG. 1 is large.

FIG. 9 is an exploded perspective view showing a part of a second embodiment of the buffer of the present invention.

FIG. 10 is a plan view showing a fixed member of which position is adjustable in the case body wherein the member is fixed in a state in which the distance therefrom to the buffering member is increased in the buffer shown in FIG. 9.

FIG. 11 is a plan view showing the fixed member of which position is adjustable in the case body wherein the member is fixed in a state in which the distance therefrom to the buffering member is reduced in the buffer shown in FIG. 9.

FIG. 12 is an exploded perspective view showing a part of a third embodiment of the buffer of the present invention.

FIG. 13 is a fourth embodiment of the buffer of the present invention.

FIG. 14 is a plan view showing a part of a fifth embodiment of the buffer of the present invention.

FIG. 15 is a perspective view of an example in which the buffer of the present invention is applied to a sliding door.

FIG. 16 is a perspective view of an example in which the buffer of the present invention is applied to a drawer.

FIG. 17 is a plan view of an example in which the buffer of the present invention is applied to a hinged door.

FIG. 18 is a perspective view of the example shown in FIG. 17.

FIG. 19 is a perspective view of an example in which the buffer of the present invention is applied to a hinged door.

FIG. 20 is a perspective view of an example in which the buffer of the present invention is applied to a sliding door.

FIG. 21 is a perspective view of another example in which the buffer of the present invention is applied to a sliding door.

FIG. 22 is a perspective view of further another example in which the buffer of the present invention is applied to a sliding door.

FIG. 23 is a plan schematic view showing an example of the buffer of the present invention in a state waiting for the first member.

FIG. 24 is a plan view showing the buffer shown in FIG. 23 in a state in which the first member is retained.

FIG. 25 is a plan view showing another example of the buffer of the present invention in a state waiting for the first member.

FIG. 26 is a plan view showing the example shown in FIG. 25 in a state in which the first member is retained.

DETAILED DESCRIPTION OF THE INVENTION

In the drawings, parts which functionally operate in the same or similar manner are denoted by the same reference numerals. In FIGS. 1 to 14 and FIGS. 23 to 26, upper covers are removed and not shown.

The constitution of a first embodiment of a buffer of the present invention will be described with reference to FIG. 1 to FIG. 8.

In FIG. 1 to FIG. 8, 1 denotes a sliding door device serving as an opening/closing device, and, for the sliding door device 1, a pair of long and thin unillustrated guide rails having approximately-U-shaped cross section is attached to upper and lower opening perimeters of an unillustrated rectangular opening. In addition, the pair of guide rails has sliding recessed portions provided along the longitudinal direction of the guide rails and having the shape of recessed grooves in the horizontal sections thereof, and the guide rails are attached to the opening perimeters of the opening in a state in which the sliding recessed portions thereof are opposed to each other in parallel.

Moreover, a rectangular flat-plate-like sliding door 2 serving as a door body is slidably attached to the pair of guide rails, such that the opening to which the pair of guide rails is attached can be opened/closed. More specifically, the upper end of the sliding door 2 is slidably fitted in the sliding recessed portion of the guide rail attached to the upper opening perimeter of the opening. In addition, the lower end of the sliding door 2 is slidably fitted in the sliding recessed portion of the guide rail attached to the lower opening perimeter of the opening.

Furthermore, a thin-long cylindrical engagement pin 3 serving as a first member upwardly protruding from the sliding door is attached to the upper end surface of the sliding door 2 which is one end surface thereof in the direction of height. The engagement pin 3 is an engagement body attached to protrude in the axial direction thereof, i.e., the height direction of the sliding door 2, and is protruding perpendicularly to the upper end surface of the sliding door. Furthermore, the engagement pin 3 is one end portion of the upper end surface of the sliding door 2 in the longitudinal direction, and provided at the widthwise center of the upper end surface of the sliding door 2. The engagement pin 3 is protrudingly provided on the upper end surface of an approximately-rectangular flat-plate-like attachment plate 4 which is attached on the upper end surface of the sliding door 2 as an attachment member.

Meanwhile, a thin-long approximately-rectangular flat-plate-like sliding door closer 11 is attached to one longitudinal end of the sliding recessed portion of the guide rail attached to the upper opening perimeter of the opening. The sliding door closer 11 is a violent-closing prevention device serving as a buffer for preventing the sliding door from being violently closed. The sliding door closer 11 has a thin-long approximately-rectangular flat-plate-like case body 12. On the upper-surface side of the case body 12, an attachment recessed portion 13 which is recessed in the longitudinal cross section of the case body 12 is provided.

Furthermore, on a bottom surface portion 14 constituting a bottom surface of the attachment recessed portion 13, a thin-long groove-like engagement groove 15 along the longitudinal direction of the case body 12 is provided. The engagement groove 15 has a width slightly larger than the diameter of the engagement pin 3 such that the engagement pin 3 of the sliding door 2 is slidably engaged with it along the longitudinal direction. The engagement groove 15 is provided from the center of the bottom surface portion 14 in the longitudinal direction to the front end side of the case body 12 in the longitudinal direction. More specifically, the engagement groove 15 is vertically penetrating the case body 12 therefrom to the front end side of the case body, and is communicated with the front end surface of the case body 12. Therefore, the engagement groove 15 formed from the front end surface of the case body 12 into the attachment recessed portion 13 is formed as a slot-like groove provided in the bottom surface portion 14 of the case body 12. Furthermore, at the opening perimeter of the engagement groove 15 in the front end side, a guiding surface portion 16 which is open in a manner tapered from the front end side of the engagement groove 15 is provided. The guiding surface portion 16 functions as guiding surfaces which facilitate engagement of the engagement pin 3 with the engagement groove 15 performed through movement of the sliding door 2.

In addition, in the bottom surface portion 14 of the attachment recessed portion 13 of the case body 12, a thin-long groove-like sliding groove 17 is provided. The sliding groove 17 has a movement groove portion 18 in the longitudinal direction of the attachment recessed portion 13. The movement groove portion 18 is provided to be adjacent and parallel to the engagement groove 15. The movement groove portion 18 is provided from the center of the attachment recessed portion in the longitudinal direction thereof to a front end portion of the attachment recessed portion 13.

Furthermore, at a front end portion of the movement groove portion 18, a thin long groove-like rotation groove portion 19 extending in the width direction of the attachment recessed portion 13 is continuously provided. The rotation groove portion 19 has a shape curved like a circular arc at the front end portion of the case body 12. The rotation groove portion 19 is formed from the center of the attachment recessed portion 13 in the width direction thereof to one side end portion of the attachment recessed portion 13 in the width direction thereof. Furthermore, the rotation groove portion 19 is communicated with the front end of the movement groove portion 18 by one end of the rotation groove portion 19.

In addition, on the bottom surface portion 14 of the attachment recessed portion 13 of the case body 12, a cylindrical spring fixing portion 21 which is vertically protruding from the bottom surface portion 14 is provided. The spring fixing portion 21 is positioned at an end portion of the attachment recessed portion 13 in the longitudinal direction, i.e., a rear end portion thereof. In other words, the spring fixing portion 21 is provided at a corner portion of the rear end portion of the attachment recessed portion 13. The spring fixing portion 21 has a cylindrical main body portion 22. At the upper end of the main body portion 22, a disk-like enlarged portion 23 having a diameter larger than that of the main body portion 22 is concentrically formed.

In addition, at one side end in the rear end side of the bottom surface portion 14 of the attachment recessed portion 13 of the case body 12, a protruding portion 24 which is upwardly protruding above the bottom surface portion 14 is integrally formed therewith. The protruding portion 24 is continuous with the rear end and the one side end of the bottom surface portion 14, and reaches approximately-center portion of the bottom surface portion 14 in the width direction. The side surface of the protruding portion 24 positioned by one side of the case body 12 with respect to the width direction is a flat surface along the longitudinal direction and the vertical direction of the case body 12. On the other side surface of the protruding portion 24, a rack 26 having teeth 25 in the longitudinal direction of the case body 12 is formed.

At one side portion in the front end of the attachment recessed portion 13 of the case body 12, a fixing groove 27 is formed. The fixing groove 27 is provided in the side which is closer to the front of the case body 12 than the attachment recessed portion 13. Specifically, the fixing groove 27 is extending from the front end of the attachment recessed portion 13 to the front end side of the case body 12, and then, bent at a right angle toward another side of the case body 12 so as to form an L-shape when viewed from top. In the fixing groove 27, a distal end of a brake plate 28 formed by bending the distal end of a thin-long rectangular flat plate body to have an L-shape is fitted in and fixed.

The brake plate 28 serves as a sliding contact member formed of, for example, a metal. Furthermore, the brake plate 28 is housed in the attachment recessed portion 13 in the longitudinal direction of the case body 12 in a state in which the distal end thereof is fixed in the fixing groove 27 of the case body 12. The brake plate 28 has a length such that the base end of the brake plate 28 abuts the front-end surface of the protruding portion 24 of the case body 12. However, it may be shorter than the abutting length. Furthermore, the brake plate 28 is housed in the attachment recessed portion 13 in a state in which it is spaced away from one widthwise side surface of the interior of the attachment recessed portion 13 of the case body 12.

To the attachment recessed portion 13 of the case body 12, a slider 31 which is slidable in the longitudinal direction of the attachment recessed portion 13 is attached. The slider 31 is attached to be relatively movable with respect to the case body 12. The slider 31 is formed to be an approximately-rectangular flat plate having a width approximately equal to the width of the attachment recessed portion 13. In a front end portion of the slider 31, a fit/insertion groove 32 extending in the longitudinal direction of the slider 31 is formed. The fit/insertion groove 32 is a groove into which the engagement pin 3 attached on the upper end surface of the sliding door 2 is slidably inserted and fitted, and has a width slightly larger than the diameter of the engagement pin 3. The fit/insertion groove 32 is open toward one end side of the slider 31, and provided in a state in which it penetrates through the slider in the thickness direction of the slider 31, i.e., vertical direction. Along the longitudinal direction of the engagement groove 15 of the case body 12, the fit/insertion groove 32 is communicated with the engagement groove in the vertical direction in a state in which the slider 31 is slidably attached to the attachment recessed portion 13 of the case body 12.

At a front-end corner portion of the slider 31, a cylindrical spring fixing portion 33 perpendicularly protruding from the lower surface of the slider 31 is provided. The spring fixing portion 33 has a cylindrical main body portion 34. At the lower end of the main body portion 34, a disk-like portion 35 having a diameter larger than the main body portion 34 is formed.

Herein, to the main body 34 of the spring fixing portion 33 fixed is one longitudinal end portion of a coil spring 36 which is a spring member serving as an elastic means formed by spirally winding a steel wire. The coil spring 36 has an elastic force in the longitudinal direction of the coil spring 36. The other end of the coil spring 36 in the longitudinal direction is fixed to the main body portion 22 of the spring fixing portion 21 of the case body 12. Therefore, the coil spring 36 energizes toward the relative moving direction of the slider 31 and the case body 12 through a posture change to a pull-in posture of a hook body 61 which will be described later.

Furthermore, at one side end in the lower surface of the slider 31, an abutting portion 37 extending in the longitudinal direction of the slider 31 is formed. On the surface of the abutting portion 37 in the height direction, that is, the widthwise surface formed is a flat abutting surface 38 which is brought into sliding contact with one side surface of the brake plate 28 which is attached to the attachment recessed portion 13 in a state in which the slider 31 is attached to the attachment recessed portion 13 of the case body 12. The abutting surface 38 is extending in the longitudinal direction and the vertical direction of the slider 31. Furthermore, a thin-long flat-plate-like brake pad 39 formed of, for example, a friction material is attached to the abutting surface 38. The brake pad 39 covers the abutting surface 38 in the longitudinal direction and the width direction of the abutting surface 38.

In addition, on the lower surface of the slider 31, a locking portion 41 is provided to be opposed to the abutting surface 38 of the abutting portion 37 of the slider 31 with a gap therebetween. The locking portion 41 is positioned to be opposed to the rear end portion of the abutting surface 38. A locking groove 42 which is extending in the width direction of the slider 31 is formed to be adjacent to the locking portion 41. Furthermore, adjacent to the side closer to the front end of the slider 31 than the locking groove 42, a locking stepped portion 43 which is positioned such that the distal end surface thereof is recessed compared with the distal end of the stepped locking portion 41 which is positioned in the rear end side of the locking groove 42.

Moreover, a pressing member 44 formed of, for example, a metal is attached to the locking groove 42 and the locking stepped portion 43. The pressing member 44 is formed by bending a thin-long rectangular flat plate body into an L-shape, and has a leg 45 in one side and a leg 46 in the other side. Furthermore, the pressing member 44 is locked such that the inner surface of the leg 45 of one side of the pressing member 44 abuts the locking stepped portion 43 and the leg 46 of the other side of the pressing member 44 is slidably fitted in the locking groove 42. In other words, the leg 46 of the other side of the pressing member 44 is slidably fitted in along the longitudinal direction of the locking groove 42 of the slider 31.

In addition, a flat-plate-like brake pad 47 formed of, for example, a friction material is attached to the outer surface of the leg 45 of the one side of the pressing member 44. The brake pad 47 covers the outer surface of the leg 45 of the pressing member 44. It is arranged such that the brake plate 28 is sandwiched between and brought into sliding contact with the brake pad 47 and the brake pad 39 which is attached on the abutting surface 38 of the slider 31.

Furthermore, at a widthwise one side portion and a rear end corner portion of the slider 31, a cut-away portion 48 in which the corner portion is cut away in the longitudinal direction and the width direction of the slider 31 is provided. To the cut-away portion 48 attached is a damper plate 52 of a rotary damper 50 to which a pinion gear 51 is attached to the lower surface thereof so as to be rotatable in the horizontal direction. The damper plate 52 is formed such that, in a state in which the slider 31 is attached to the attachment recessed portion 13 of the case body 12, teeth 53 provided on the outer circumferential surface of the pinion gear 51 in the circumferential direction thereof are rotatably engaged with the teeth 25 of the rack 26 of the case body 12. The rotary damper 50 performs a buffering action with respect to movement of the slider 31 against the rotation of the pinion gear 51.

In addition, in the front end side of the slider 31, a bearing hole 54 vertically penetrating the slider in the vertical direction of the slider 31 is provided. The bearing hole 54 is positioned in the side closer to the front than the locking groove 42, and provided between fit/insertion groove 32 and the longitudinal side end of the slider. Furthermore, the bearing hole 54 is provided in the side closer to the rear than the fit/insertion groove 32. Moreover, the hook body 61 which serves as a buffering member is rotatably attached to the bearing hole 54. The hook body 61 presses the case body 12 through abutment with the engagement pin 3 caused by movement of the sliding door 2, and slides in the case body 12 together with the slider 31 while maintaining a state in which the case body 12 is being pressed, thereby buffering relative movement of the slider 31 and the case body 12. Specifically, the hook body 61 undergoes a posture change, through abutment with the engagement pin 3 caused by the movement of the sliding door 2, from a waiting-position posture for waiting the abutment to the pull-in posture which is a retaining posture for retaining the engagement pin 3 through rotation. Furthermore, the hook body 61 has a flat-plate-like main body portion 62. On the upper surface of the main body portion 62 provided is a cylindrical short shaft 63 which is rotatably supported by the bearing hole 54 of the slider 31. The short shaft 63 is positioned at a corner portion of one side portion in the rear end side of the main body portion 62.

Furthermore, on the back surface of the main body portion 62 formed is an engagement projecting portion 64 which is slidably and respectively engaged with the movement groove portion 18 and the rotation groove portion 19 of the sliding groove portion 17 of the case body 12. The engagement projecting portion 64 has a lengthwise dimension with which it can be slidably fitted in the movement groove portion 18 of the sliding groove 17, and has a widthwise dimension with which it can be rotatably fitted in the rotation groove portion 19 of the sliding groove portion 17. Therefore, each of the both side ends of the engagement projecting portion 64 is formed to be like a circular arc along the rotation groove portion 19 of the sliding groove portion 17.

In addition, on the one side portion of the main body portion 62 of the hook body 61 provided is an inclined surface portion 65 which is inclined in the width direction from the rim of the short shaft 63 of the hook body 61 to the rim of the engagement projecting portion 64. In the rear end side of the other side portion of the main body portion 62 which is in the other side of the inclined surface portion 65, an inclined surface portion 66 which is inclined in parallel to the inclined surface portion 65 is formed. In the front end side of the inclined surface portion 66 formed is a retaining recessed portion 67 which is formed to be recessed toward the one side end from the other side end of the main body portion 2. The retaining recessed portion 67 is open from the widthwise center portion of the main body portion 62 toward the other side end. The retaining recessed portion 67 is vertically penetrating through the main body portion 62.

Furthermore, on a side rim in the side closer to the front end than the retaining recessed portion 67 of the main body portion 62, an operating recessed portion 68 having a recessed shape is formed. Between the operating recessed portion 68 and the retaining recessed portion 67, a protruding surface portion 69 is formed. Furthermore, at a corner portion of the rear end portion of the main body portion 62 formed is an engagement stepped portion 71 which is formed to be stepped toward the rear end side of the main body portion 62. The engagement stepped portion 71 is fitted to and presses against the inner surface of the leg 45 of one side of the pressing member 44 in a state in which the short shaft 63 of the hook body 61 is rotatably fitted in the bearing hole 54 of the slider 31. More specifically, by pressing the pressing member 44 by the engagement stepped portion 71, the engagement stepped portion 71 causes the brake pad 47 which is attached to the outer surface of the leg 45 of one side of the pressing member 44 to abut the side surface of the brake plate 28.

Operations of the sliding door closer of the first embodiment will next be described.

First, an operation of closing the sliding door 2 is performed, thereby moving the engagement pin 3, which is attached to the upper end surface of the sliding door 2, toward the sliding door closer 11 side as shown in FIG. 2 to FIG. 4.

In this course, while the engagement pin is being fitted in the engagement groove 15 of the case body 12 of the sliding door closer 11 and the fit/insertion groove 32 of the slider 31, the engagement pin 3 on the sliding door 2 is slid in the engagement groove 15 and the fit/insertion groove 32, and brought into abutment with the retaining recessed portion 67 of the hook body 61 so as to be fitted therein.

Then, the abutment of the engagement pin 3 with the retaining recessed portion 67 of the hook body 61 causes the hook body 61 to be pressed toward the rear end side. As a result, the front end side of the hook body 61 rotates counterclockwise, and the engagement pin 3 is fitted and retained in the retaining recessed portion 67 of the hook body 61.

In this course, while the engagement projecting portion 64 of the hook body 61 is being guided by the rotation groove portion 19 of the sliding groove 17 of the case body 12, the hook body 61 rotates about the short shaft 63 which is fitted in the bearing hole 54 of the slider 31 and serving as the center of rotation. Then, the engagement projecting portion 64 of the hook body 61 moves to the movement groove portion of the sliding groove 17 of the case body 12.

As a result, the engagement between the engagement projecting portion 64 and the rotation groove portion 19 is released, and, as shown in FIG. 5, the hook body 61, the engagement pin 3, and the slider 31 are moved to the rear end portion of the case body 12 by an elastic force of the coil spring 36 operating as a tension spring.

In this course, the teeth 53 of the pinion gear 51 of the rotary damper 50 which is attached to the slider 31 are meshed with the teeth 25 of the rack 26 of the case body 12. Therefore, along with the movement of the hook body 61, the engagement pin 3, and the slider 31, the pinion gear 51 rotates with respect to the rack 26, and, as shown in FIG. 6, until the rear end side of the slider 31 abuts the rear end side of the attachment recessed portion 13 of the case body 12, the hook body 61 and the engagement pin 3 are respectively moved to predetermined positions together with the slider 31.

Herein, when the closing speed of the sliding door 2 is comparatively slow, and: when the abutting force of the engagement pin 3 of the sliding door 2 with respect to the retaining recessed portion 67 of the hook body 61 is smaller than the elastic force of the coil spring 36; or, when a buffering action caused by the rotary damper 50 is acted on the rack 26, and the abutting force is smaller than the resultant force of the rotation resistance force with respect to the pinion gear 51 of the rotary damper 50, the meshing resistance force of the rack 26 and the pinion gear 51, and the elastic force of the coil spring 36; as shown in FIG. 7, the engagement pin 3 is pressed by the inner surface of the retaining recessed portion 67 of the hook body 61, and the engagement pin 3 is reliably moved to a predetermined position.

On the other hand, when the closing speed of the sliding door 2 is comparatively fast, and: when the abutting force of the engagement pin 3 of the sliding door 2 with respect to the retaining recessed portion 67 of the hook body 61 is larger than the elastic force of the coil spring 36; or, when the buffering action caused by the rotary damper 50 is caused, and the abutting force is larger than the resultant force of the rotation resistance force of the pinion gear 51 of the rotary damper 50, the meshing resistance force of the rack 26 and the pinion gear 51 and the elastic force of the coil spring 36; as shown in FIG. 8, the inner surface of the leg 45 of one side of the pressing member 44 is pressed by the engagement stepped portion 71 of the hook body 61, the brake pad 47 of the pressing member 44 holds down the other side surface of the brake plate 28, and one side surface of the brake pad 28 holds down the brake pad 39 which is attached to the abutting surface 38 of the slider 31.

Therefore, along the movement of the hook body 61, the engagement pin 3, and the slider 31, the brake plate 28 is brought into sliding contact with the brake pad 47 of the pressing member 44 and the brake pad 39 of the slider 31 while the plate is being sandwiched therebetween, such that the movement of the engagement pin 3 toward the rear end side is buffered.

Furthermore, from the state in which the opening is closed by the sliding door 2, the sliding door 2 is subjected to an opening operation, wherein the engagement pin 3 on the sliding door 2 is moved toward the front end side of the sliding door closer 11.

In this course, the slider 31 is moved via the hook body 61 to the front end side of the case body 12 by the movement of the engagement pin 3 to the front end side, thereby extending the coil spring 36.

At the same time, when the engagement pin 3 is moved to the front end side, the engagement pin 3 presses the front end side of the interior of the retaining recessed portion 67 of the hook body 61, thereby rotating the hook body 61 clockwise.

As a result, pressing against the brake plate 28 performed by the engagement stepped portion 71 of the hook body 61 via the pressing member 44 is released by the clockwise rotation of the hook body 61. Therefore, the opening operation of the sliding door 2 can be smoothly performed, since the sliding door 2 can be subjected to the opening operation in a state in which the buffering action caused by the pressing against the brake plate 28 performed by the pressing member 44 is released.

In this state, when the sliding door 2 is operated to be further opened, the hook body 61 is pressed by the engagement pin 3 on the sliding door 2, and the engagement projecting portion 64 of the hook body 61 is guided from the movement groove portion 18 of the sliding groove 17 of the case body 12 to the rotation groove portion 19.

As a result, the hook body 61 rotates clockwise and changes its posture to the waiting-position posture, wherein the engagement and retainment of the engagement pin 3 performed by the retaining recessed portion 67 of the hook body 61 is released, and the engagement projecting portion 64 of the hook body 61 is engaged with the rotation groove portion 19 of the sliding groove portion 17 of the case body 12, thereby retaining the coil spring 36 in an extended state.

As described above, according to the first embodiment, when the closing speed of the sliding door 2 is comparatively slow, and the abutting force with respect to the retaining recessed portion 67 of the hook body 61 from the engagement pin 3 of the sliding door 2 is smaller than the elastic force of the coil spring 36, or when the buffering action caused by the rotary damper 50 is applied, and the abutting force is smaller than the resultant force of the rotation resistance force and the friction force of the pinion gear 51 of the rotary damper 50 with respect to the rack 26 and the elastic force of the coil spring 36; the engagement pin 3 can be reliably moved to the predetermined position since the engagement pin 3 is pressed by the inner surface of the retaining recessed portion 67 of the hook body 61 by the elastic force of the coil spring 36.

Therefore, the sliding door 2 can be reliably prevented from being stopped due to the slow closing speed of the sliding door 2, before the opening is completely closed by the sliding door 2.

Furthermore, when the sliding door 2 is to be subjected to an opening operation, the engagement pin 3 presses the front end side of the interior of the retaining recessed portion 67 of the hook body 61, and the hook body 61 is rotated.

Consequently, the pressing against the brake plate 28 of the pressing member 44 performed by the hook body 61 is released; therefore, the sliding door 2 can be operated to be smoothly opened.

If the closing speed of the sliding door 2 is comparatively fast, and the abutting force of the engagement pin 3 of the sliding door 2 with respect to the retaining recessed portion 67 of the hook body 61 is larger than the elastic force of the coil spring 36, or if the buffering action caused by the rotary damper 50 is applied, and the abutting force is larger than the resultant force of the rotation resistance force and the friction force with respect to the rack 26 from the pinion gear 51 of the rotary damper 50 and the elastic force of the coil spring 36, the engagement stepped portion 71 of the hook body 61 presses the pressing member 44 when the hook body 61 is moved, and the brake plate 28 is brought into sliding contact with the brake pad 47 of the pressing member 44 and the brake pad 39 of the slider 31 while the plate is being sandwiched therebetween.

Therefore, the friction forces of the brake plate 28 respectively caused by pressing of the brake pad 47 of the pressing member 44 and the brake pad 39 of the slider 31 act against the elastic force of the coil spring 36, thereby reliably buffering the movement of the engagement pin 3 toward the rear end side. As a result, the sliding door 2 can be reliably prevented from being bounded back and causing the opening to be incompletely closed due to the inertia that the sliding door 2 has when the closing speed of the sliding door 2 is fast.

Therefore, the pressing force of the hook body 61 with respect to the engagement pin 3 is changed in accordance with the force of abutment of the engagement pin 3 with respect to the retaining recessed portion 67 of the hook body 61 depending on the difference in the closing speed of the sliding door 2. Accordingly, buffering corresponding to the moving speed of the sliding door 2 to which the engagement pin 3 is attached can be reliably achieved. Therefore, even when the sliding door 2 is closed at any speed, the opening can be reliably closed by the sliding door 2. Thus, violent closing of the sliding door 2 can be reliably prevented.

Furthermore, when the hook body 61 is rotated counterclockwise by abutment of the engagement pin 3 with the retaining recessed portion 67 of the hook body 61, the hook body 61 undergoes a posture change from the waiting-position posture for waiting abutment of the engagement pin 3 to the pull-in posture for pulling in and retaining the engagement pin 3. As a result, through the posture change from the waiting-position posture to the pull-in posture carried out by the rotation of the hook body 61, the outlet of the engagement pin 3 can be completely blocked by the inner surface of the retaining recessed portion 67 of the hook body 61. Therefore, abutment of the engagement pin 3 with respect to the retaining recessed portion 67 of the hook body 61 can be reliably retained, and the hook body 61 can be returned to the waiting-position posture from the pull-in posture by rotation of the hook body 61 in the opposite direction.

Moreover, after the hook body 61 is rotated to undergo a posture change to the pull-in posture in a state in which the engagement pin 3 is fitted in the retaining recessed portion 67 of the hook body 61, the hook body 61 is energized by the elastic force of the coil spring 36 in the moving direction in which the hook body 61 moves. As a result, if the abutment force of the engagement pin 3 with respect to the retaining recessed portion 67 of the hook body 61 is below the elastic force of the coil spring 36, or if the buffering action caused by the rotary damper 50 is applied, and the abutting force is below the resultant force of the rotation resistance force and the friction force of the rotary damper 50 and the elastic force of the coil spring 36, the hook body 61 can be automatically moved by the elastic force of the coil spring 36.

Furthermore, since the hook body 61 and the slider 31 are slidably housed in the attachment recessed portion 13 of the case body 12, and the brake plate 28 is attached in the attachment recessed portion 13 of the case body 12, the hook body 61, the slider 31, and the brake plate 28 can be attached to an existing sliding door or sliding door device by attaching the case body 12 to the interior of a sliding recessed portion of a guide rail. Thus, the sliding door closer 11 having the hook body 61, the slider 31, and the brake plate 28 can be attached afterward; therefore, usability of the sliding door closer 11 can be improved.

If the abutting force of the engagement pin 3 with respect to the retaining recessed portion 67 of the hook body 61 is larger than the elastic force of the coil spring 36, or if the buffering action caused by the rotary damper 50 is applied, and the abutting force is larger than the resultant force of the rotation resistance force and the friction force of the rotary damper 50 and the elastic force of the coil spring 36, the engagement stepped portion 71 of the hook body 61 presses the pressing member 44, thereby activating the brake mechanism in which the brake plate 28 is brought into sliding contact with the brake pad 47 of the pressing member 44 and the brake pad 39 of the slider 31 while the plate is being sandwiched therebetween. Therefore, since the friction forces of the brake plate 28 respectively caused by pressing of the brake pad 47 of the pressing member 44 and the brake pad 39 of the slider 31 are exerted, the friction force and the resistance force which are caused when the pinion gear 51 of the rotary damper 50 is engaged with the rack 26 and rotated can be reduced.

Therefore, each of the rotary damper 50 and the rack 26 can be downsized.

Herein, the rotary damper 50 exert effects particularly when the closing speed of the sliding door 2 is slow and the sliding door 2 is pulled in by the coil spring 36, or when the closing speed of the sliding door 2 is fast, wherein the buffering action caused by the sliding door closer 11 with respect to the sliding door 2 consequently slows down the closing speed of the sliding door 2, and the sliding door 2 is pulled in by the coil spring 36. In other words, the rotary damper 50 works such that the sliding door 2 is closed while braking the energizing force of the coil spring 36.

In the first embodiment, the hook body 61 is brought into sliding contact with the brake plate 28 via the pressing member 44; however, the pressing member 44 can be brought into direct sliding contact with the case body 12, the guide rail serving as a fixed member, etc. Also, although the hook body 61 and the pressing member 44 are separately formed, they can be arranged such that the pressing member 44 is integrally formed with the hook body 61 as a part thereof, and the hook body 61 is brought into direct sliding contact with the brake plate 28, the case body 12, and the guide rail.

Furthermore, like a second embodiment shown in FIG. 9 to FIG. 11, an adjustment mechanism 80 which can adjust the brake plate 28 in the attachment recessed portion 13 of the case body 12 in the width direction of the case body 12 can be provided in the case body 12. The adjustment mechanism 80 adjusts the distance between the brake plate 28 and the brake pad 47 of the pressing member 44 by adjusting the distance between the hook body 61 and the brake plate 28 or the case body 12.

Specifically, the adjustment mechanism 80 has a plurality of, for example four in total, cylindrical projecting portions 81 which are provided on the upper surface and the lower surface of the brake plate 28 so as to project therefrom. The projecting portions 81 are provided on both the upper surface and the lower surface of the brake plate 28. The projecting portions 81 which are provided on the lower surface of the brake plate 28 so as to project therefrom are slidably engaged with elongated-bore-like elongated bored grooves 82 which are provided in the bottom surface portion 14 of the attachment recessed portion 13 of the case body 12. The elongated bored grooves 82 have a longitudinal direction in the direction which is inclined with respect to the longitudinal direction of the case body 12. Furthermore, the elongated bored grooves 82 have a width which is slightly larger than the diameter of the engagement projecting portions 81.

In addition, an engagement recessed portion 83 is provided at the rear end of the brake plate 28 which is one end thereof in the longitudinal direction. The engagement recessed portion 83 is formed like an elongated groove which is open toward one side surface side of the brake plate 28. Furthermore, on the inner periphery of the bottom surface portion of the engagement recessed portion 83, a removal preventing groove 84 having a diameter larger than the inner peripheral surface of the engagement recessed portion 83 is formed. Moreover, to the engagement recessed portion 83 attached is a cylindrical screw 85 on which a male thread is formed on the outer peripheral surface thereof. At the distal end of the screw 85 in the axial direction, an engagement projecting portion 86 to be engaged with the engagement recessed portion 83 of the brake plate 28 is provided. The distal end of the engagement projecting portion 86 is engaged with the removal preventing groove 84 of the engagement recessed portion 83 of the brake plate 28, and a removal preventing portion 87 which causes the distal end of the screw 85 to be rotatably coupled to the engagement recessed portion 83 is provided along the circumferential direction thereof.

Furthermore, at the base end portion of the screw 85 in the axial direction, a first bevel gear 91 is rotatably attached to the case body 12. The first bevel gear 91 is formed to have an approximately-cylindrical shape, and a screw hole 92 on which a female thread is formed on the inner peripheral surface thereof is provided. The base end side of the screw 85 is rotatably screwed in the base end side of the screw hole 92. Furthermore, a bevel-gear surface 93 which is tapered toward the distal end side of the first bevel gear 91 is formed on the outer peripheral surface of the first bevel gear 91 in the distal end side thereof.

Moreover, a bevel-gear surface 95 of a second bevel gear 4 which is housed in the attachment recessed portion 13 of the case body 12 is rotatably meshed with the bevel-gear surface 93 of the first bevel gear 91. The bevel-gear surface 5 of the second bevel gear 94 is formed such that the diameter of the upper side of the lower end thereof is reduced toward the distal end side in the axial direction of the second bevel gear 94. A cross-shaped operating groove 96 is formed on the base end surface of the second bevel gear 94. It is arranged such that the tip portion of an unillustrated Phillips screwdriver serving as a tool can be fitted in the operating groove 96, and the second bevel gear 94 can be operated to be rotated by the Phillips screwdriver. The second bevel gear 94 is rotatably retained in the attachment recessed portion 13 of the case body 12 in a state in which the operating groove 6 of the second bevel gear 94 is exposed from the lower surface of the case body 12 through a circular insertion hole 97 provided in the bottom surface portion 14 of the attachment recessed portion 13 of the case body 12.

Therefore, when the second bevel gear 94 is rotated by the Phillips screwdriver in a state in which the tip portion of the Phillips screwdriver is inserted in the insertion hole 7 of the case body 12, and fitted in the operating groove 96 of the second bevel gear 94, the first bevel gear 91 is rotated along with the rotation of the second bevel gear 94, thereby moving the screw 85 in the longitudinal direction. In this course, because of the movement of the screw body 85, while the engagement projecting portions 81 of the brake plate 28 are being respectively guided by the elongated bored grooves 82 of the case body 12, the brake plate 28 moves in the width direction of the case body 12, thereby adjusting the gap between the brake plate 28 and the brake pad 47 of the pressing member 44.

As a result, by adjusting the gap between the brake plate 28 and the brake pad 47 of the pressing member 44, adjustment corresponding to the heavy-weight sliding door 2 or the light-weight sliding door 2 can be performed, and the gap between the brake plate 28 and the brake pad 47 of the pressing member 44 can be adjusted in the state in which the sliding door closer 11 is attached in the sliding recessed portion of the guide rail; therefore, usability of the sliding door closer 11 can be further improved.

Furthermore, like a third embodiment shown in FIG. 12, the adjustment mechanism 80 can be arranged such that the position of the brake plate 28 can be adjusted from one side of the attachment recessed portion 13 of the case body 12. In this case, the adjustment mechanism 80 has the elongated bored grooves 82 having a longitudinal direction in the width direction of the case body 12. Furthermore, on one side surface of the attachment recessed portion 13 of the case body 12 formed is a cut-away recessed portion 101 wherein the portion is cut away to be recessed downwardly from the upper end of the attachment recessed portion 13. The removal-preventing portion 87 of the screw 85 is rotatably engaged with the cut-away recessed portion 101. Furthermore, on one widthwise side surface of the plate 28 for braking, a screw hole 102 on which a female thread is formed is formed. The base end side of the screw 85 is rotatably screwed in the screw hole 102.

Therefore, when the screw 85 which is fitted in the cut-away recessed portion 101 of the case body 12 is rotated from the side of the case body 12, while the projecting portions 81 of the brake plate 28 are being respectively guided by the elongated bored grooves 82 of the case body 12, the brake plate 28 moves in the width direction of the case body 12, thereby adjusting the gap between the brake plate 28 and the brake pad 47 of the pressing member 44. As a result, by adjusting the gap between the brake plate 28 and the brake pad 47 of the pressing member 44, adjustment corresponding to the heavy-weight sliding door 2 or the light-weight sliding door 2 can be performed; therefore, the usability of the sliding door closer 11 can be further improved.

Also, like a fourth embodiment shown in FIG. 13, the hook body 61 can be arranged to undergo sliding contact along with movement of the engagement pin 3. In this case, the retaining recessed portion 67 of the hook body 61 is open in the longitudinal direction of the case body 12, and also open to be in communication with the fit/insertion groove 32 of the slider 31. In addition, at mutually opposed positions on the inner surface of the retaining recessed portion 67 of the hook body 61 respectively provided are locking projecting portions 03 which lock the engagement pin 3 by this retaining recessed portion 67 such that it can be unlocked. Furthermore, on the inner surface of the retaining recessed portion 67 closer to the opening side than the locking projecting portions 103, guiding surface portions 104 which are open toward the distal end side are formed.

Herein, the hook body 61 is formed by, for example, a synthetic resin, so as to be elastically deformable. The pressing performed by the engagement stepped portion 71 of the hook body 61 brings the brake pad 47 of the pressing member 44 into sliding contact with one of the inner surfaces of the attachment recessed portion 13 of the case body 12.

As a result, movement in a direction different from the sliding direction of the slider 31 with respect to the case body 12, that is, rotation of the hook body 61 is performed along with the movement of the slider 31; therefore, the hook body 61 can be moved to a position wherein the buffering effect can be obtained again. The embodiment of this type does not use the coil spring, the rotary damper, the pinion gear, and the rack which are provided between the case body and the slider.

Furthermore, like a fifth embodiment shown in FIG. 14, even when a magnet 105 is attached to the hook body 61 instead of providing the retaining recessed portion 67, and the engagement pin 3 is formed of a magnetic body such as a metal, the engagement pin 3 can be engaged and retained by the magnet 105 of the hook body 61, and the hook body 61 is arranged to be rotated and brought into sliding contact along with the movement of the engagement pin 3; therefore, operations and effects similar to those of the above described fourth embodiment can be exerted. In this case, at least either one of the hook body 61 and the engagement pin 3 is required to be formed of magnet. The embodiment of this type does not use the coil spring, the rotary damper, the pinion gear, and the rack.

In the above described embodiments, the sliding door closer 11 used for the sliding door 2 has been described; however, it can be adopted to be used even for a moving member other than the sliding door 2 such as a drawer, a hinged door, or a folding door. In addition, although the movement of the sliding door 2 in the closing direction has been buffered by the sliding door closer 11, the movement of the sliding door 2 in the opening direction can be also buffered by the sliding door closer 11.

FIG. 15 shows an application example in which the buffer of the present invention is applied. In the drawing, an upper guide rail 106 of a pair of guide rails is formed to have two stages, the case body 12 is attached in the upper-stage guide rail, and the sliding door 2 is supported by four-wheeled carriages 108, which travel in the lower-stage guide rail, via supporting shafts 107. The engagement pin 3 is attached to an extending portion 109 of the base of the four-wheeled carriage protruding in the width direction of the sliding door 2. In this case, even when the sliding door 2 swiftly travels in the closing direction of the sliding door 2 in the guide rail 106 by means of the four-wheeled carriage 108, the buffering action is exerted in accordance with the traveling speed when the engagement pin 3 of the sliding door 2 enters the case body 12; therefore, rebounding is not caused.

FIG. 16 shows an example in which the buffer of the present invention is applied to a drawer. Specifically, the buffer of the present invention is applied such that the case body 12 is embedded inside of a sidewall of a cabinet 111, and the engagement pin 3 is attached to a sidewall of a drawer 112, thereby preventing rebounding when the drawer 112 is closed.

FIG. 17 shows an example of a case in which the buffer of the present invention is applied to a hinged door. In this example, a hinged door 115 is attached to a hinged-door attachment frame 117 via a hinge 116. The engagement pin 3 is attached to a base extending portion 109 of the carriage 108 traveling in the guide rail 106. One end of a link arm 118 is attached to the carriage 108, and the other end thereof is rotatably attached to an upper portion of the hinged-door attachment frame 117. When the hinged-door is to be closed, the buffering action is caused between the engagement pin 3 and the case body 12, the speed of closing the hinged door can be reduced, and rebounding of the hinged door can be prevented.

FIG. 17 shows a change from a state in which the hinged door 115 is opened at 90 degrees to states of an intermediate position for closing the hinged door and a completely closed position. In this course, the engagement pin 3 enters into the engagement groove 15 of the case body 12 in the course of closing the hinged door 115, thereby causing a buffering effect of reducing the closing movement speed as it gets closer to a closed position. Therefore, even when the hinged door 115 is operated in the closing direction with a great force, it can be closed without being rebounded. Moreover, it is advantageous in that it can be produced at lower cost compared with conventional piston-type door closers, and it is not easily broken even when it is violently operated. FIG. 18 shows the hinged door of FIG. 17 in an opened state.

FIG. 19 shows a perspective view of another example in which the buffer of the present invention is applied to a hinged door. In this case, the case body 12 is embedded in a top panel 120 of a storage case. The engagement pin 3 is attached to an angled plate 121 which is fixed to an upper corner portion of the inner side of the hinged door 115. The buffer of this example can be produced at further lower cost than the buffer shown in FIG. 17 and FIG. 18.

FIG. 20 is a perspective view of an example in which the buffer of the present invention is applied to the sliding door 2. In this example, an axle 123 is energized and protruding from the upper surface of the sliding door 2. A guiding ring 124 which abuts and is guided by the opening perimeter of the upper-stage guide rail of the upper guide rail 106 is rotatably attached onto the axle, the engagement pin 3 is protruding from the upper end portion of the guiding ring 124, and the engagement pin 3 can be moved in the upper-stage guide rail. In addition, to the sliding door 2 attached are traveling bodies 126 which support the sliding door 2 and travel on a lower guide rail 125. In this example, the sliding door 2 is supported via the traveling bodies 126 and travels on the lower guide rail 125, and the engagement pin 3 is smoothly guided by the guiding ring which abuts and is guided by the opening perimeter of the upper-stage guide rail of the upper guide rail 106 such that it can be moved forward into or backward from the engagement groove of the case body; thus, a good buffering effect can be obtained. In a case in which a vertical adjustment mechanism of the sliding door 2 is provided in the traveling bodies 126, even when a vertical adjustment operation is performed and the gap between the upper surface of the sliding door 2 and the upper guide rail is changed, the protruding amount of the engagement pin in the upper-stage guide rail is always kept constant, since the axle 123 is energized such that the guiding ring always abuts the opening periphery of the upper guide rail. Therefore, even when vertical adjustment of the sliding door 2 is performed, a stable buffering effect can be obtained since the amount of abutment between the engagement pin 3 and the hook body is not increased or reduced. In this example, the upper guide rail 106 is comprised of the upper-stage guide rail and the lower-stage guide rail; however, the lower-stage guide rail may not be provided since the lower-stage guide rail has a strong design effect of blocking the gap between the upper surface of the sliding door and the upper-stage guide rail.

FIG. 21 shows a perspective view of another example in which the buffer of the present invention is applied to the sliding door 2. In this example, the case body 12 is attached to the sliding door 2 such that it is on the same plane as the upper surface of the sliding door 2, and the engagement pin 3 is attached to the upper guide rail 106.

In the above described embodiments, the buffering effect can be improved when the hook body serving as the buffering member presses the case body or a member fixed to the case body so as to buffer the relative movement of the first member and the case body, and the relative movement of the first member and the case body is buffered by the rotary damper, the pinion gear, and the rack provided in the slider or the case body.

According to the present invention, the hook body applies a pressing force to the inner wall of one side of the case body or to a member which is adjacent to the inner wall and fixed to the case body through rotation of the hook body. In addition to such embodiment, the buffering action can be arranged to be caused in a double-sided manner wherein the hook body applies pressing forces to the inner walls of the both sides of the case body or members which are adjacent to both the inner walls and fixed to the case body through rotation of the hook body.

FIG. 22 shows further another example in which the buffer of the present invention is applied to the sliding door 2. In this case, the case body 12 is embedded in a lower side of the lower guide rail 125, the sliding door 2 is suspended by the carriages 108 so as to travel in the upper guide rail 106, and the engagement pins 3 engaged with the lower guide rail 125 are protrudingly provided on the lower surface of the sliding door 2 so as to perform a guiding function and serve as the engagement pins 3 of the buffer.

FIG. 23 and FIG. 24 are plan views of a sixth embodiment of the buffer of the present invention. FIG. 23 shows a state in which the hook body 61 is at a waiting-posture position for waiting the engagement pin 3. This embodiment is different from the first embodiment shown in FIG. 1 to FIG. 8 in the following points. First, it is different in the points that: the rack 26 is formed to protrude from the bottom of the case body 12 in the side illustrated in the lower side, a narrowed part at the right end of the tension coil spring 36 is sandwiched by a sandwiching portion 130 which is protruding from the bottom of the case body 12 above the rack 26 so as to be fixed, and a narrowed part at the left end of the tension coil spring 36 is sandwiched by a sandwiching portion 131 which is formed to protrude from the bottom of the slider 31.

Furthermore, it is different in the point that the hook body 61 does not have the operating recessed portion 68, but has a cam-like projecting portion 72 instead of the engagement stepped portion 71. Pin protrusions which are formed to protrude from the bottom of the case body in order to attach an unillustrated upper cover are denoted by 132 and 133. In FIG. 23, for example when the sliding door is to be closed, in the buffer, the engagement pin 3 serving as the first member enters the engagement groove 15 from the left end, and abuts and subsequently presses the right rim of the retaining recessed portion 67 of the hook body 61, such that the hook body 61 is turned counterclockwise, and the cam-like projecting portion 72 of the hook body 61 presses the brake pad 47 which is provided on the leg 46 of the pressing member 44 toward the brake plate 28. At the same time, the engagement pin 3 is reliably retained in the retaining recessed portion, and the engagement projecting portion 64 of the hook body 61 moves from the rotation groove portion 19 of the sliding groove 17 to the movement groove 18.

As a result, the engagement between the engagement projecting portion 64 and the rotation groove portion 19 is released, and the slider 31 is moved toward the right side by the elastic force of the coil spring 36 which operates as a tension spring attached between the sandwiching portion 131 of the slider 31 and the sandwiching portion 132 of the case body 12. In this course, the cam-like projecting portion 72 of the hook body 61 presses the brake pad 47 on the leg 45 of the pressing member 44 against the brake plate 28. In this course, the brake plate is interposed, like a sandwich, between the brake pad 39 attached to the slider wall of the slider 31 and the brake pad 47 attached to the leg of the pressing member 44, a braking force caused by friction is applied to the movement of the slider 31, and the movement of the slider 31 is buffered.

In addition, the rotary damper 50 is fixed to the slider 31, and the movement of the slider 31 is buffered by the buffering action caused by the rotary damper and the meshing resistance force of the teeth 53 of the pinion gear 51 attached to the rotation axis of the rotary damper 50 and the teeth 25 of the rack 26 formed on the bottom inner surface of the case body. FIG. 24 shows a plan view of a state in which the slider 31 is moved to an end position. This figure clarifies that the engagement projecting portion 64 of the hook body 61 is in the movement groove portion of the sliding groove 17, and the state in which the pressing member 44 is caused by the cam-like projecting portion 72 of the hook body to press the brake plate 28.

When the engagement pin 3, which is the first member, is brought into abutment with and caused to press the left side rim of the retaining recessed portion 67 from the state shown in FIG. 24, a clockwise turning force is applied to the hook body 61. The pressing action of the cam-like projecting portion 72 of the hook body 61 toward the leg 46 of the pressing member 44 is reduced. The braking force with respect to the brake plate 28 is also attenuated. When the movement of the slider toward left gets over the tension force of the coil spring 36 so as to move to the left, and the slider 31 slides in the movement groove portion of the sliding groove to the left, the hook body 61 turns clockwise when the engagement projecting portion 64 is at the left end of the movement groove, such that it is fitted in the rotation groove 18.

As described above, the rotary damper 50 and the pinion gear 51 are provided on the slider 31, and the rack 26 is provided on the case body 12; however, the rack 26 can be provided on the slider, and the rotary damper 50 and the pinion gear 51 can be provided on the case body.

FIG. 25 and FIG. 26 are plan views of a seventh embodiment of the buffer of the present invention. This embodiment has a constitution of the elastic means different from that of the first embodiment shown in FIG. 1 to FIG. 8. Specifically, the elastic means of this embodiment uses a compression coil spring 36 which accumulates spring energy through compression. One end of the compression coil spring 36 in the longitudinal direction is seated on the inner surface of the front end of the case body 12, and the other end thereof is seated on the inner surface of a protruding portion which is protruding from the lower surface of the slider 31. Therefore, as well as the first embodiment, this compression coil spring energizes in the relative moving direction of the slider and the case body.

What is claimed is:

1. A buffer, comprising:

an engagement member, a case body relatively movable with respect to the engagement member, a slider provided in the case body and slidable in a longitudinal direction of the case body;

a buffering member rotatably attached to the slider;

a pressing member attached to the slider and having an engagement stepped portion or a cam projecting portion;

a brake plate fixed to the case body;

a first brake pad attached to the pressing member;

a second brake pad attached to the slider; and an elastic means for moving the slider relative to the case body; wherein the buffering member is rotated through abutment with the engagement member such that the engagement stepped portion or cam projecting portion presses the pressing member and moves along with movement of the engagement member or the case body while retaining the pressing state by sandwiching the brake plate between the first brake pad and the second brake pad by the engagement stepped portion or the cam projecting portion so as to buffer relative movement of the engagement member and the case body.

2. The buffer according to claim 1, further comprising:

a rotary damper fixed to one end portion of the slider which is provided with the buffering member on the other end portion, a pinion gear fixed to a rotation axis of the rotary damper; and a rack fixed to the case body; wherein the pinion gear and the rack are meshed with each other.

3. The buffer according to claim 1, further comprising:

an adjustment mechanism for adjusting the position of the brake plate in the width direction of the case body, wherein the adjustment mechanism has a plurality of projecting portions which are provided on first and second surfaces, respectively, of the brake plate, and elongated bored grooves which are provided in a surface portion of the attachment recessed portion of the case body, with which the plurality of projecting portions which are provided on the second surface is slidably engaged.

4. The buffer according to claim 1, further comprising:

an adjustment mechanism for adjusting the position of the brake plate in the width direction of the case body, wherein the adjustment mechanism has a first bevel gear attached to the case body; and a second bevel gear which is rotatably meshed with the bevel-gear surface of the first bevel gear.

5. The buffer according to claim 1, further comprising:

an adjustment mechanism for adjusting the position of the brake plate in the width direction; wherein the adjustment mechanism has a screw hole on one widthwise side surface of the brake plate, and the base end side of the screw is rotatably screwed in the screw hole.

* * * * *